US011112709B2

(12) United States Patent
Saeki et al.

(10) Patent No.: US 11,112,709 B2
(45) Date of Patent: Sep. 7, 2021

(54) TONER AND TONER MANUFACTURING METHOD

(71) Applicant: CANON KABUSHIKI KAISHA, Tokyo (JP)

(72) Inventors: Tatsuya Saeki, Suntou-gun (JP); Shuntaro Watanabe, Hadano (JP); Hiroki Akiyama, Suntou-gun (JP); Hiroki Kagawa, Mishima (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,623

(22) Filed: Jun. 12, 2019

(65) Prior Publication Data

US 2019/0384195 A1 Dec. 19, 2019

(30) Foreign Application Priority Data

Jun. 13, 2018 (JP) ..... JP2018-113067
Apr. 10, 2019 (JP) ..... JP2019-074943

(51) Int. Cl.
*G03G 9/087* (2006.01)

(52) U.S. Cl.
CPC ..... *G03G 9/08711* (2013.01); *G03G 9/08755* (2013.01)

(58) Field of Classification Search
CPC ..... G03G 9/08702; G03G 9/08728
See application file for complete search history.

(56) References Cited

U.S. PATENT DOCUMENTS 7,014,969 B2 3/2006 Yachi et al.
7,678,523 B2 3/2010 Hiroko et al.
7,842,446 B2 11/2010 Yanase et al.
7,923,190 B2 4/2011 Magome et al.
7,935,467 B2 5/2011 Dojo et al.
8,426,091 B2 4/2013 Magome et al.
8,426,094 B2 4/2013 Magome et al.
8,603,712 B2 12/2013 Aoki et al.
8,614,044 B2 12/2013 Matsui et al.
8,741,519 B2 6/2014 Watanabe et al.
8,778,585 B2 7/2014 Matsui et al.
8,785,101 B2 7/2014 Kaya et al.
8,841,054 B2 9/2014 Dojo et al.
8,846,284 B2 9/2014 Kinumatsu et al.
8,883,389 B2 11/2014 Matsui et al.
9,097,997 B2 8/2015 Nomura et al.
9,201,323 B2 12/2015 Nishikawa et al.
9,213,250 B2 12/2015 Nomura et al.
9,217,943 B2 12/2015 Matsui et al.
9,239,528 B2 1/2016 Hasegawa et al.
9,250,548 B2 2/2016 Nomura et al.
9,261,804 B2 2/2016 Yamazaki et al.
9,304,422 B2 4/2016 Matsui et al.
9,309,349 B2 4/2016 Watanabe et al.
9,341,970 B2 5/2016 Yoshiba et al.
9,348,245 B2 * 5/2016 Morita ..... G03G 9/08795
9,348,246 B2 5/2016 Magome et al.
9,354,545 B2 5/2016 Matsui et al.
9,429,860 B2 8/2016 Kinumatsu et al.
9,442,416 B2 9/2016 Magome et al.
9,442,419 B2 9/2016 Wakabayashi et al.
9,470,993 B2 10/2016 Nishikawa et al.
9,581,934 B2 2/2017 Ito et al.
9,606,462 B2 3/2017 Nomura et al.
9,658,546 B2 5/2017 Tanaka et al.
9,658,554 B2 5/2017 Kinumatsu et al.
9,798,256 B2 10/2017 Kosaki et al.
9,798,262 B2 10/2017 Toyoizumi et al.
9,811,016 B2 11/2017 Aoki et al.
9,823,595 B2 11/2017 Toyoizumi et al.
9,829,818 B2 11/2017 Yoshiba et al.
9,857,707 B2 1/2018 Tsuda et al.
9,857,713 B2 1/2018 Kosaki et al.
9,869,943 B2 1/2018 Aoki et al.
9,904,195 B2 2/2018 Matsui et al.
10,012,919 B2 7/2018 Matsui et al.
10,101,683 B2 10/2018 Nishikawa et al.
10,156,800 B2 12/2018 Tsuda et al.
10,197,934 B2 2/2019 Matsui et al.
10,241,430 B2 3/2019 Kimura et al.
10,289,016 B2 5/2019 Fukudome et al.
10,295,921 B2 5/2019 Ohmori et al.
2004/0185367 A1 9/2004 Serizawa et al.
2007/0166636 A1 7/2007 Daimon et al.
2009/0087768 A1 4/2009 Tosaka et al.
2009/0197192 A1 8/2009 Hiroko et al.
2010/0035171 A1 2/2010 Watanabe et al.
2014/0038098 A1 2/2014 Naka et al.
2014/0272699 A1 * 9/2014 Minaki ..... G03G 9/08764 430/109.3
2014/0308611 A1 10/2014 Shimano et al.
2015/0185658 A1 7/2015 Wakabayashi et al.

(Continued)

FOREIGN PATENT DOCUMENTS

EP 0 703 505 3/1996
EP 0 744 668 11/1996

(Continued)

OTHER PUBLICATIONS

Fedors, "A Method for Estimating Both the Solubility Parameters and Molar Volumes of Liquids", Polymer Engineering and Science, vol. 14, No. 2 (1974) 147-54.

(Continued)

*Primary Examiner* — Peter L Vajda
(74) *Attorney, Agent, or Firm* — Venable LLP

(57) ABSTRACT

A toner comprising a toner particle containing a binder resin, the storage elastic modulus Gt' (150) of the toner at 150° C. is at least $1.0\times10^4$ Pa, the binder resin contains a polymer A having a first monomer unit derived from a first polymerizable monomer and a second monomer unit derived from a second polymerizable monomer different from the first polymerizable monomer, the first polymerizable monomer is selected from specific (meth)acrylic acid esters, the contents of the first monomer unit and second monomer unit in the polymer A are within specific ranges, and the SP values of the first monomer unit and second monomer unit are within specific ranges.

16 Claims, No Drawings

(56) References Cited

U.S. PATENT DOCUMENTS

| | | | | |
|---|---|---|---|---|
| 2016/0139522 | A1 | 5/2016 | Yoshiba et al. | |
| 2016/0161874 | A1 | 6/2016 | Yamazaki et al. | |
| 2017/0045834 | A1 | 2/2017 | Shirai et al. | |
| 2017/0269496 | A1 | 9/2017 | Kubo et al. | |
| 2018/0143557 | A1 | 5/2018 | Ueda et al. | |
| 2018/0231901 | A1 | 8/2018 | Koji et al. | |
| 2020/0379363 | A1 * | 12/2020 | Nagaoka | G03G 9/08755 |

FOREIGN PATENT DOCUMENTS

| | | | | |
|---|---|---|---|---|
| EP | 1 494 087 | | 1/2005 | |
| EP | 2626745 | * | 10/2011 | G03G 9/087 |
| EP | 2 626 745 | | 8/2013 | |
| EP | 2626745 | * | 8/2013 | G03G 9/087 |
| EP | 2 843 473 | | 3/2015 | |
| JP | 2000-250264 | | 9/2000 | |
| JP | 2003-107774 | | 4/2003 | |
| JP | 2011-094137 | | 5/2011 | |
| JP | 2013-228724 | | 11/2013 | |
| JP | 2014-130243 | | 7/2014 | |
| JP | 2014-222259 | | 11/2014 | |

OTHER PUBLICATIONS

U.S. Appl. No. 16/438,537, Kentaro Kamae, filed Jun. 12, 2019.
U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/438,545, Kenta Kamikura, filed Jun. 12, 2019.
U.S. Appl. No. 16/438,553, Kenji Aoki, filed Jun. 12, 2019.
U.S. Appl. No. 16/438,566, Takashi Matsui, filed Jun. 12, 2019.
U.S. Appl. No. 16/438,605, Daisuke Yoshiba, filed Jun. 12, 2019.
U.S. Appl. No. 16/438,611, Hiroki Kagawa, filed Jun. 12, 2019.
U.S. Appl. No. 16/259,159, Shuntaro Watanabe, filed Jan. 28, 2019.
U.S. Appl. No. 16/272,254, Shuntaro Watanabe, filed Feb. 11, 2019.

* cited by examiner

TONER AND TONER MANUFACTURING METHOD

BACKGROUND OF THE INVENTION

Field of the Invention

The present invention relates to a toner for use in electrophotographic methods, electrostatic recording methods, magnetic recording methods and the like, and to a method for manufacturing the toner.

Description of the Related Art

Higher printing speeds are recently in demand in electrophotographic apparatuses. This demand increases every year, and the low-temperature fixability of toners is being improved with the aim of reducing the fixing time.

To improve low-temperature fixability, methods have been proposed for reducing the glass transition temperature of the amorphous binder resin that is a principal component of ordinary toners. However, because heat-resistant storage stability declines when the glass transition temperature is reduced, toners with low glass transition temperatures designed to satisfy demands low-temperature fixability have problems of insufficient heat-resistant storage stability during long-term storage and transport at high temperatures.

Crystalline resins have therefore been studied as binder resins that can provide both low-temperature fixability and heat-resistant storage stability. Unlike amorphous resins, crystalline resins do not have a clear glass transition point, and have the property of not changing their states before the melting point. Because they form regular arrays of molecules, moreover, they have a sharp-melt property of melting rapidly at the melting point. Consequently, they have the feature of being able to provide both heat-resistant storage stability and low-temperature fixability.

For example, as an improvement yielding a sharp-melt property, Japanese Patent Application Publication No. 2014-130243 proposes using, as the binder resin of a toner, a crystalline vinyl resin obtained by co-polymerizing a polymerizable monomer having a long-chain alkyl group and an amorphous polymerizable monomer.

Japanese Patent Application Publication No. 2003-107774 proposes improving image density non-uniformity during fixing by using a three-dimensionally crosslinked resin for the binder resin.

SUMMARY OF THE INVENTION

However, when the sharp-melt property is improved by using a large amount of a crystalline vinyl resin as in Japanese Patent Application Publication No. 2014-130243, a small temperature changes causes a large change in the molten state of the toner. The problem of image density non-uniformity during fixing has been found to be more likely to occur in high-speed machines as a result. This is thought to be because the time taken to pass through the fixing unit is shorter in high-speed machines, and therefore the temperature received by the toner is greatly affected by bumps and depressions in the paper.

A problem of developing performance has also been found in high-speed machines, in which the image density is reduced when an image is printed with a large amount of toner as in the case of an overall solid image. This is thought to be because charge leaks are likely to occur due to the reduced electrical density in the crystalline segments, so that the toner as a whole cannot be sufficiently charged.

On the other hand, while image density non-uniformity is improved to a certain degree with the method of Japanese Patent Application Publication No. 2003-107774, this has been found to be insufficient when the three-dimensionally crosslinked resin is used together with a crystalline resin. This is thought to be because the crystalline segments and insoluble segments are not uniformly present in the toner during melting. Moreover, this still does not solve the problem of density with overall solid images.

Thus, it is extremely difficult to all demands with respect to developing performance and image density non-uniformity while also improving heat-resistant storage stability and low-temperature fixability.

The present invention provides a toner that has excellent heat-resistant storage stability and low-temperature fixability, and can provide image density uniformity and developing performance at a high level.

A first embodiment of the present invention relates to a toner comprising a toner particle containing a binder resin, wherein the storage elastic modulus Gt' (150) of the toner at 150° C. is at least $1.0\times10^4$ Pa, the binder resin contains a polymer A having a first monomer unit derived from a first polymerizable monomer and a second monomer unit derived from a second polymerizable monomer different from the first polymerizable monomer, the first polymerizable monomer is at least one selected from the group consisting of (meth)acrylic acid esters having a $C_{18-36}$ alkyl group, the content of the first monomer unit in the polymer A is 5.0 mol % to 60.0 mol % of the total moles of all the monomer units in the polymer A, the content of the second monomer unit in the polymer A is 20.0 mol % to 95.0 mol % of the total moles of all monomer units in the polymer A, and when the SP value of the first monomer unit is $SP_{11}$ $(J/cm^3)^{0.5}$, and the SP value of the second monomer unit is $SP_{21}$ $(J/cm^3)^{0.5}$, the following formula (1) is satisfied:

$$3.00\leq(SP_{21}-SP_{11})\leq25.00 \quad (1).$$

A second embodiment of the invention relates to a toner comprising a toner particle containing a binder resin, wherein the storage elastic modulus Gt' (150) of the toner at 150° C. is at least $1.0\times10^4$ Pa, the binder resin contains a polymer A that is a polymer of a composition containing a first polymerizable monomer and a second polymerizable monomer different from the first polymerizable monomer, the first polymerizable monomer is at least one selected from the group consisting of (meth)acrylic acid esters having a $C_{18-36}$ alkyl group, the content of the first polymerizable monomer in the composition is 5.0 mol % to 60.0 mol % of the total moles of all polymerizable monomers in the composition, the content of the second polymerizable monomer in the composition is 20.0 mol % to 95.0 mol % of the total moles of all polymerizable monomers in the composition, and when the SP value of the first polymerizable monomer is $SP_{12}$ $(J/cm^3)^{0.5}$, and the SP value of the second polymerizable monomer is $SP_{22}$ $(J/cm^3)^{0.5}$, the following formula (2) is satisfied:

$$0.60\leq(SP_{22}-SP_{12})\leq15.00 \quad (2).$$

The present invention can provide a toner that has excellent heat-resistant storage stability and low-temperature fixability while providing both image density uniformity and developing performance at a high level.

Further features of the present invention will become apparent from the following description of exemplary embodiments.

DESCRIPTION OF THE EMBODIMENTS

Unless otherwise specified, descriptions of numerical ranges such as "at least A and not more than B" or "A to B" in the present invention include the numbers at the upper and lower limits of the range.

In the present invention, a (meth)acrylic acid ester means an acrylic acid ester and/or methacrylic acid ester.

In the present invention, a "monomer unit" means a reacted form of a monomer substance in a polymer.

A crystalline resin is a resin that exhibits a clear endothermic peak in differential scanning calorimetry (DSC).

To give a toner both a sharp-melt property and heat-resistant storage stability, it is effective to use a crystalline resin as the principal component of the binder resin in the toner. However, when a crystalline resin is the principal component it may inhibit charging during development, and adversely affect uniform wet spreading during fixing.

In a toner having low-temperature fixability and heat-resistant storage stability, it is therefore essential to increase the developing performance and image density uniformity during fixing. However, it is not easy to achieve all of these. Of course, it is possible to improve heat-resistant storage stability while promoting a sharp-melt property by including a large quantity of a substance such as a crystalline resin or low-melting-point wax. However, because such substances have low electrical resistance, they may cause problems with the developing performance of the toner in electrophotographic systems. Moreover, the molten state of the toner may be affected by small changes in temperature when the sharp-melt property is emphasized.

In light of these problems, we discovered that developing performance could be achieved while providing low-temperature fixability and heat-resistant storage stability at a high level in the present invention. The toner of the invention can be used in higher-speed machines, and also has good image density uniformity during fixing, which is related to a trade-off with low-temperature fixability.

In the present invention, the storage elastic modulus Gt' (150) of the toner at 150° C. must be at least $1.0\times10^4$ Pa.

When the toner is exposed to just enough heat to melt it from the outside, its viscoelasticity naturally declines, but it is believed that the storage elastic modulus stays at a constant value at high temperatures because the insoluble component of the toner maintains the toner as a whole at a constant viscoelasticity.

Image density non-uniformity during fixing can be good if the storage elastic modulus of the toner is high at high temperatures, and so the value of the storage elastic modulus at 150° C. must be at least $1.0\times10^4$ Pa, and is preferably at least $2.0\times10^4$ Pa, or more preferably at least $2.7\times10^4$ Pa. There is no particular upper limit, but preferably it is not more than $1.0\times10^{-7}$ Pa, or more preferably not more than $1.0\times10^6$ Pa. This value can be controlled by controlling the molecular weight and crosslinking density of the binder resin.

In the first embodiment of the invention, the binder resin contains a polymer A having a first monomer unit derived from a first polymerizable monomer and a second monomer unit derived from a second polymerizable monomer different from the first polymerizable monomer. Moreover, the first polymerizable monomer is at least one selected from the group consisting of (meth)acrylic acid esters having a $C_{18-36}$ alkyl group, and the content of the first monomer unit in the polymer A is 5.0 mol % to 60.0 mol % of the total moles of all monomer units in the polymer A, while the content of the second monomer unit in the polymer A is 20.0 mol % to 95.0 mol % of the total moles of all monomer units in the polymer A. Furthermore, when the SP value of the first monomer unit is $SP_{11}$ $(J/cm^3)^{0.5}$, and the SP value of the second monomer unit is $SP_{21}$ $(J/cm^3)^{0.5}$, the following formula (1) is satisfied:

$$3.00\leq(SP_{21}-SP_{11})\leq25.00 \quad (1).$$

In the second embodiment of the invention, the binder resin contains a polymer A that is a polymer of a composition containing a first polymerizable monomer and a second polymerizable monomer different from the first polymerizable monomer. The first polymerizable monomer is at least one selected from the group consisting of (meth)acrylic acid esters having a $C_{18-36}$ alkyl group, the content of the first polymerizable monomer in the composition is 5.0 mol % to 60.0 mol % of the total moles of all polymerizable monomers in the composition, and the content of the second polymerizable monomer in the composition is 20.0 mol % to 95.0 mol % of the total moles of all polymerizable monomers in the composition. Moreover, when the SP value of the first polymerizable monomer is $SP_{12}$ $(J/cm^3)^{0.5}$, and the SP value of the second polymerizable monomer is $SP_{22}$ $(J/cm^3)^{0.5}$, the following formula (2) is satisfied:

$$0.60\leq(SP_{22}-SP_{12})\leq15.00 \quad (2).$$

SP value here is an abbreviation for solubility parameter, and is used as an indicator of solubility. The calculation methods are described below.

The SP value in the invention is given in units of $(J/m^3)^{0.5}$, but this can be converted to units of $(cal/cm^3)^{0.5}$ using the formula 1 $(cal/cm^{-3})^{0.5}=2.045\times10^3$ $(J/m^3)^{0.5}$.

In the present invention, the value of $SP_{21}-SP_{11}$ is 3.00 to 25.00, or preferably 5.00 to 22.00, or more preferably 6.00 to 20.00.

In the second embodiment, the value of $SP_{22}-SP_{12}$ is 0.60 to 15.00, or preferably 3.00 to 12.00.

If the above conditions are met, the melting point can be maintained without reducing the crystallinity of the polymer A. It is thus possible to achieve both low-temperature fixability and heat-resistant storage stability. The mechanism for this is thought to be as follows.

Crystallinity is expressed when the first monomer unit is incorporated into the polymer A and the first monomer units aggregate together, but ordinarily it is difficult to express crystallinity in the polymer because crystallization is inhibited by incorporation of other monomer units. This tendency is particularly evident when the first monomer units and other monomer units bind randomly in a single molecule of the polymer.

In the present invention, however, it is thought that because the polymer A is constituted using polymerizable monomers such that $SP_{22}-SP_{12}$ is within the aforementioned range or constituted from monomer units such that $SP_{21}-SP_{11}$ is within the aforementioned range, the first polymerizable monomer and second polymerizable monomer can bind continuously to a certain degree rather than binding randomly during polymerization. Thus, the first monomer units can aggregate together in the polymer A, and even if other monomer units are incorporated it is possible to maintain the melting point because crystallinity can be increased.

Furthermore, it is thought that if $SP_{21}-SP_{11}$ is within the aforementioned range, it is possible to form a clear phase separation state without mutual dissolution of the first monomer unit and second monomer unit in the polymer A, so that crystallinity is not reduced and the melting point can be maintained.

The polymer A preferably has crystalline segments containing a first monomer unit derived from a first polymerizable monomer. The polymer A also preferably has amorphous segments containing a second monomer unit derived from a second polymerizable monomer.

If $SP_{22}-SP_{12}$ is less than 0.60, the melting point of the polymer A is reduced, and heat-resistant storage stability declines. If it exceeds 15.00, on the other hand, it is thought that the copolymerizability of the polymer A will be poor, resulting in non-uniformity and a decrease in low-temperature fixability.

Similarly, if $SP_{21}-SP_{11}$ is less than 3.00 the melting point of the polymer A is reduced, and heat-resistant storage stability declines. If it exceeds 25.00, on the other hand, it is thought that the copolymerizability of the polymer A will be poor, resulting in non-uniformity and a decrease in low-temperature fixability.

It is important that the first polymerizable monomer be at least one selected from the group consisting of (meth)acrylic acid esters having (preferably straight-chain) a $C_{18-36}$ alkyl group. If the first polymerizable monomer is a specific (meth)acrylic acid ester, the polymer A has crystallinity, and it is possible to achieve storability while improving low-temperature fixability by means of the sharp-melt property.

From the standpoint of improving low-temperature fixability, the first polymerizable monomer is preferably at least one selected from the group consisting of (meth)acrylic acid esters having (preferably straight-chain) alkyl groups with not more than 30 carbon atoms. From the standpoint of improving storability, the first polymerizable monomer is preferably at least one selected from the group consisting of (meth)acrylic acid esters having (preferably straight-chain) alkyl groups with at least 22 carbon atoms.

Moreover, in the first embodiment the content of the first monomer unit in the polymer A is 5.0 mol % to 60.0 mol % of the total moles of all monomer units in the polymer A.

In the second embodiment, the content of the first polymerizable monomer in the composition is 5.0 mol % to 60.0 mol % of the total moles of all polymerizable monomers in the composition.

The content of the first monomer unit or first polymerizable monomer is preferably 10.0 mol % to 60.0 mol %, or more preferably 20.0 mol % to 40.0 mol %. If the content is within this range, the crystalline part of the toner exhibits a good sharp-melt property, and low-temperature fixability is improved.

In the first embodiment, moreover, the content of the second monomer unit in the polymer A is 20.0 mol % to 95.0 mol % of the total moles of all monomer units in the polymer A. In the second embodiment, the content of the second polymerizable monomer in the composition is 20.0 mol % to 95.0 mol % of the total moles of all polymerizable monomers in the composition.

The content of the second monomer unit or second polymerizable monomer is preferably 40.0 mol % to 95.0 mol %, or more preferably 40.0 mol % to 70.0 mol %. If the content is within this range, the degree of crystallization of the first monomer unit in the polymer A is increased, resulting in good low-temperature fixability and storability.

In addition to the first monomer unit and second monomer unit, a third monomer unit derived from a third polymerizable monomer outside the scope of either formula (1) or formula (2) above may also be included in the polymer A. In this case, when the SP value of the third monomer unit is $SP_{31}$ $(J/cm^3)^{0.5}$, $SP_{31}$ is preferably equal to or greater than $SP_{11}$ but less than $SP_{21}$ in the first embodiment. In the second embodiment, when the SP value of the third polymerizable monomer is $SP_{32}$ $(J/cm^3)^{0.5}$, $SP_{32}$ is preferably equal to or greater than $SP_{12}$ but less than $SP_{22}$. Within this range, the degree of crystallization of the first monomer unit in the polymer A is increased, resulting in good storability.

It is important that the first polymerizable monomer be at least one selected from the group consisting of (meth)acrylic acid esters having a $C_{18-36}$ alkyl group.

Examples of the (meth)acrylic acid esters having a $C_{18-36}$ alkyl group include (meth)acrylic acid esters having a $C_{18-36}$ straight-chain alkyl group [stearyl (meth)acrylate, nonadecyl (meth)acrylate, eicosyl (meth)acrylate, heneicosanyl (meth)acrylate, behenyl (meth)acrylate, lignoceryl (meth) acrylate, ceryl (meth)acrylate, octacosyl (meth)acrylate, myrisyl (meth)acrylate, dotriacontyl (meth)acrylate, etc.] and (meth)acrylic acid esters having a $C_{18-36}$ branched alkyl group [2-decyltetradecyl (meth)acrylate, etc.].

Of these, at least one selected from the group consisting of (meth)acrylic acid esters having a $C_{18-36}$ straight-chain alkyl group is preferred, at least one selected from the group consisting of (meth)acrylic acid esters having a $C_{18-30}$ straight-chain alkyl group is more preferred, and at least one selected from the group consisting of straight-chain stearyl (meth)acrylate and behenyl (meth)acrylate is still more preferred.

One kind of monomer alone or a combination of two or more kinds may be used for the first polymerizable monomer.

Of those given below for example, a polymerizable monomer conforming to formula (1) or (2) may be used as the second polymerizable monomer. One kind of monomer alone or a combination of two or more kinds may be used for the second polymerizable monomer.

Monomers having nitrile groups: for example, acrylonitrile, methacrylonitrile and the like.

Monomers having hydroxyl groups: for example, 2-hydroxyethyl (meth)acrylate, 2-hydroxypropyl (meth)acrylate and the like.

Monomers having amide groups: for example, acrylamide and monomers obtained by reacting $C_{1-30}$ amines with $C_{2-30}$ carboxylic acids having ethylenically unsaturated bonds (acrylic acid, methacrylic acid, etc.) by known methods.

Monomers having urethane groups: for example, monomers obtained by reacting $C_{2-22}$ alcohols having ethylenically unsaturated bonds (2-hydroxyethyl methacrylate, vinyl alcohol, etc.) by known methods with $C_{1-30}$ isocyanates [monoisocyanate compounds (benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate and 2,6-dipropylphenyl isocyanate, etc.), aliphatic diisocyanate compounds (trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate and 2,4,4-trimethylhexamethylene diisocyanate, etc.), alicyclic diisocyanate compounds (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate and hydrogenated tetramethylxylylene diisocyanate, etc.) and aromatic diisocyanate compounds (phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate and xylylene diisocyanate, etc.) and the like], and monomers obtained by reacting $C_{1-26}$ alcohols (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol, etc.) by known methods with $C_{2-30}$ isocyanates having ethylenically unsaturated bonds [2-isocyanatoethyl (meth)acrylate, 2-(0-[1'-methylpropylidenamino]carboxyamino) ethyl (meth) acrylate, 2-[(3,5-dimethylpyrazolyl(carbonylamino] ethyl (meth)acrylate and 1,1-(bis(meth)acryloyloxymethyl) ethyl isocyanate, etc.] and the like.

Monomers having urea groups: for example, monomers obtained by reacting $C_{3-22}$ amines [primary amines (normal butylamine, t-butylamine, propylamine, and isopropylamine, etc.), secondary amines (di-normal ethylamine, di-normal propylamine, di-normal butylamine, etc.), aniline, cycloxylamines and the like] by known methods with $C_{2-30}$ isocyanates having ethylenically unsaturated bonds and the like.

Monomers having carboxyl groups: for example, methacrylic acid, acrylic acid, 2-carboxyethyl (meth)acrylate.

Of these, it is desirable to use a monomer having a nitrile, amide, urethane, hydroxyl or urea group. A monomer having an ethylenically unsaturated bond and at least one functional group selected from the group consisting of nitrile, amide, urethane, hydroxyl and urea groups is still more preferred.

The vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate and vinyl octylate can also be used by preference as the second polymerizable monomer.

Because vinyl esters are nonconjugated monomers and can easily maintain an appropriate degree of reactivity with the first polymerizable monomer, it becomes easier to increase the crystallinity of the polymer A and better achieve both low-temperature fixability and heat-resistant storage stability.

The second polymerizable monomer preferably has an ethylenically unsaturated bond, and more preferably has one ethylenically unsaturated bond.

Moreover, the second polymerizable monomer is preferably at least one selected from the group consisting of the following formulae (A) and (B).

(A)

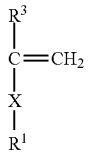

-continued (B)

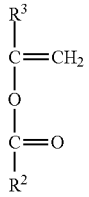

(In the formulae, X represents a single bond or $C_{1-6}$ alkylene group, and $R^1$ represents a nitrile group (—C≡N), amide group (—C(=O)NHR$^{10}$ ($R^{10}$ being a hydrogen atom or $C_{1-4}$ alkyl group)), hydroxyl group, —COOR$^{11}$ ($R^{11}$ being a $C_{1-6}$ (preferably $C_{1-4}$) alkyl group or $C_{1-6}$ (preferably $C_{1-4}$) hydroxyalkyl group), urethane group (—NHCOOR$^{12}$ ($R^{12}$ being a $C_{1-4}$ alkyl group)), urea group (—NH—C(=O)—N($R^{13}$)$_2$ (in which each $R^{13}$ is independently a hydrogen atom or $C_{1-6}$ (preferably $C_{1-4}$) alkyl group, —COO($CH_2$)$_2$NHCOOR$^{14}$ ($R^{14}$ being a $C_{1-4}$ alkyl group) or —COO($CH_2$)$_2$—NH—C(=O)—N($R^{15}$)$_2$ (in which each $R^{15}$ is independently a hydrogen atom or $C_{1-6}$ (preferably $C_{1-4}$) alkyl group).

Preferably $R^1$ is a nitrile group (—C≡N), amide group (—C(=O)NHR$^{10}$ ($R^{10}$ being a hydrogen atom or $C_{1-4}$ alkyl group)), hydroxyl group, —COOR$^{11}$ ($R^{11}$ being a $C_{1-6}$ (preferably $C_{1-4}$) alkyl group or $C_{1-6}$ (preferably $C_{1-4}$) hydroxyalkyl group), urea group (—NH—C(=O)—N($R^{13}$)$_2$ (in which each $R^{13}$ is independently a hydrogen atom or $C_{1-6}$ (preferably $C_{1-4}$) alkyl group, —COO($CH_2$)$_2$NHCOOR$^{14}$ ($R^{14}$ being a $C_{1-4}$ alkyl group) or —COO($CH_2$)$_2$—NH—C(=O)—N($R^{15}$)$_2$ (in which each $R^{15}$ is independently a hydrogen atom or $C_{1-6}$ (preferably $C_{1-4}$) alkyl group).

$R^2$ is a $C_{1-4}$ alkyl group, and each $R^3$ is independently a hydrogen atom or methyl group).

A monomer unit in the present invention is defined as one carbon-carbon bonded section in a principal chain composed of polymerized vinyl monomers in a polymer.

A vinyl monomer can be represented by formula (A) below.

(A)

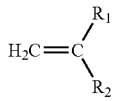

[In formula (A), $R_1$ represents a hydrogen atom or alkyl group (preferably a $C_{1-3}$ alkyl group, or more preferably a methyl group), and $R_2$ represents any optional substituent.]

When multiple kinds of monomer units fulfilling the conditions for the first monomer unit are present in the polymer A in the present invention, the value of $SP_{11}$ in Formula (1) is a weighted average of the SP values of each of these monomer units. For example, if the polymer contains A mol % of a monomer unit A with an SP value of $SP_{111}$ based on the total moles of the monomer units fulfilling the conditions for the first monomer unit and (100−A) mol % of a monomer unit B with an SP value of $SP_{112}$ based on the total moles of the monomer units fulfilling the conditions for the first monomer unit, the SP value ($SP_{11}$) is:

$$SP_{11}=(SP_{111}\times A+SP_{112}\times(100-A))/100.$$

The calculation is similar when three or more monomer units fulfilling the conditions for the first monomer unit are included. Similarly, $SP_{12}$ also represents an average value calculated based on the molar ratios of the respective first polymerizable monomers.

Moreover, the second monomer unit in the present invention corresponds to all monomer units having $SP_{21}$ values satisfying formula (1) in combination with the $SP_{11}$ value calculated by the methods described above. Similarly, the second polymerizable monomer corresponds to all polymerizable monomers having $SP_{22}$ values satisfying formula (2) in combination with the $SP_{12}$ value calculated by the methods described above.

That is, when the second polymerizable monomer is two or more kinds of polymerizable monomer, $SP_{21}$ represents the SP values of monomer units derived from each of the polymerizable monomers, and $SP_{21}-SP_{11}$ is determined for the monomer units derived from each of the second polymerizable monomers. Similarly, $SP_{22}$ represents the SP values of each of the polymerizable monomers, and $SP_{22}-SP_{12}$ is determined for each of the second polymerizable monomers.

The polymer A may also contain a third monomer unit derived from a third polymerizable monomer outside the scope of the formulae (1) and (2) (that is, different from the first polymerizable monomer and second polymerizable monomer) as long as the molar ratios of the first and second monomer units remain within the stipulated ranges.

Examples of the third polymerizable monomer include styrenes such as styrene and o-methylstyrene and their derivatives, and (meth)acrylic acid esters such as n-butyl (meth)acrylate, t-butyl (meth)acrylate and 2-ethylhexyl (meth)acrylate.

To improve the storability of the toner, the third polymerizable monomer is preferably at least one selected from the group consisting of styrene, methyl methacrylate and methyl acrylate.

The polymer A is preferably a vinyl polymer. The vinyl polymer may be a polymer of a monomer containing an ethylenically unsaturated bond for example. An ethylenically unsaturated bond is a radical polymerizable carbon-carbon double bond, and examples include vinyl, propenyl, acryloyl and methacryloyl groups and the like.

The first monomer unit in the polymer A is preferably contained in the amount of at least 7 mol %, or more preferably at least 15 mol % of the total monomer units in the binder resin. There is no particular upper limit, but preferably the content is not more than 80 mol %, or more preferably not more than 60 mol %. If the first monomer unit in the polymer A is contained in this amount in the binder resin, low-temperature fixability is good because the sharp-melt property is improved.

The acid value of the polymer A is preferably not more than 30.0 mg KOH/g, or more preferably not more than 20.0 mg KOH/g. There is no particular lower limit, but preferably it is at least 0 mg KOH/g. If the acid value is not more than 30.0 mg KOH/g, a good melting point is maintained because crystallization of the polymer A is unlikely to be inhibited.

The weight average molecular weight (Mw) of the tetrahydrofuran (THF)-soluble component of the polymer A as measured by gel permeation chromatography is preferably 8,000 to 200,000, or more preferably 12,000 to 100,000. If the Mw is within this range, good brittleness of the toner near room temperature is obtained.

The melting point of the polymer A is preferably 50° C. to 80° C., or more preferably 53° C. to 70° C. If the melting point of the polymer A is within this range, good heat-resistant storage stability and low-temperature fixability are obtained.

The binder resin contained in the toner particle preferably contains a polymer B different from the polymer A.

Examples of the polymer B include vinyl resins, polyester resins, epoxy resins and polyurethane resins. For purposes of controlling viscoelasticity at high temperatures, it is especially desirable to include a vinyl resin or polyester resin to make it easier to control the crosslinking density. To achieve good dispersibility of the polymer B in the toner, it is especially desirable to include a polyester resin with an SP value close to that of the amorphous part of the polymer A.

From the standpoint of heat-resistant storage stability, the glass transition temperature (Tg) of the polymer B is preferably at least 55° C., or more preferably at least 60° C., or still more preferably at least 65° C. From the standpoint of not inhibiting the low-temperature fixability of the polymer A, the glass transition temperature (Tg) is preferably not more than 90° C., or more preferably not more than 80° C.

The content of the polymer A in the binder resin is preferably 40 mass % to 100 mass %, or more preferably 50 mass % to 90 mass %.

The content of the polymer B in the binder resin is preferably 0 mass % to 60 mass %, or more preferably 10 mass % to 50 mass %.

Examples of polymerizable monomers that can be used in vinyl resins include polymerizable monomers usable as the first polymerizable monomer, second polymerizable monomer and third polymerizable monomer described above. A combination of two or more kinds may be used as necessary.

When a vinyl resin is used for the polymer B, the vinyl resin preferably has a crosslinked structure obtained crosslinked with a crosslinking agent having two or more vinyl groups. Examples of the crosslinking agent used in this case include the following:

Aromatic divinyl compounds (divinyl benzene, divinyl naphthalene); diacrylate compounds connected by alkyl chains (ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and these compounds with methacrylate substituted for the acrylate); diacrylate compounds connected by alkyl chains containing ether linkages (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and these compounds with methacrylate substituted for the acrylate); diacrylate compounds connected by chains containing aromatic groups and ether linkages [polyoxyethylene (2)-2,2-bis(4-hydroxyphenyl) propane diacrylate, polyoxyethylene (4)-2,2-bis(4-hydroxyphenyl) propane diacrylate, and these compounds with methacrylate substituted for the acrylate]; and polyester diacrylate compounds.

The following are examples of multifunctional crosslinking agents: pentaerythritol triacrylate, trimethylol ethane triacrylate, trimethylol propane triacrylate, tetramethylol methane tetraacrylate, oligoester acrylates, and these compounds with methacrylate substituted for the acrylate; and triallyl cyanurate and triallyl trimellitate.

These crosslinking agents may be used in the amount of preferably 0.01 to 10.00 mass parts, or more preferably 0.03 to 5.00 mass parts per 100 mass parts of the monomer components other than the crosslinking agent.

Of these crosslinking agents, aromatic divinyl compounds (especially divinyl benzene) and diacrylate compounds connected by chains containing aromatic groups and ether linkages are examples of agents that can be used favorably from the standpoint of the offset resistance and fixability of the binder resin.

Furthermore, the polymer B preferably contains a polyester resin having a monomer unit derived from a polyhydric alcohol and a monomer unit derived from a polyvalent carboxylic acid. Initial developing performance is better if the polymer B contains a polyester resin.

The writers believe that since the SP value of the polymer B is close to the SP value of the second monomer unit of the polymer A and the polymer A and polymer B are in close proximity, there are fewer aggregates of polymer A units with each other, and charge leakage is suppressed as a result.

Examples of polyvalent carboxylic acids include the following compounds: dibasic acids such as succinic acid, adipic acid, sebacic acid, phthalic acid, isophthalic acid, terephthalic acid, malonic acid and dodecenylsuccinic acid, and anhydrides and lower alkyl esters of these, as well as aliphatic unsaturated dicarboxylic acids such as maleic acid, fumaric acid, itaconic acid and citraconic acid; and 1,2,4-benzenetricarboxylic acid, 1,2,5-benzenetricarboxylic acid, and anhydrides and lower alkyl esters of these. One of these alone or a combination of two or more may be used.

Examples of polyhydric alcohols include the following compounds: alkylene glycols (ethylene glycol, 1,2-propylene glycol and 1,3-propylene glycol); alkylene ether glycols (polyethylene glycol and polypropylene glycol); alicyclic diols (1,4-cyclohexane dimethanol); bisphenols (bisphenol A); and alkylene oxide (ethylene oxide and propylene oxide) adducts of alicyclic diols or bisphenols.

The alkyl parts of alkylene glycols and alkylene ether glycols may be either straight-chain or branched. Other examples include glycerin, trimethylol ethane, trimethylol propane and pentaerythritol. One of these alone or a combination of two or more may be used.

A monovalent acid such as acetic acid or benzoic acid or a monohydric alcohol such as cyclohexanol or benzyl alcohol may also be used as necessary to adjust the acid value or hydroxyl value.

In the first embodiment, moreover, preferably the polymer B contains a polyester resin having a monomer unit derived from a polyhydric alcohol and a monomer unit derived from a polyvalent carboxylic acid, and when the SP value of the monomer unit derived from a polyvalent carboxylic acid is $SP_{41}$ $(J/cm^3)^{0.5}$, preferably the following formula (3), or more preferably the following formula (3)' is satisfied.

$$0.0 \leq |(SP_{41}-SP_{21})| \leq 6.5 \quad (3)$$

$$0.0 \leq |(SP_{41}-SP_{21})| \leq 5.5 \quad (3)'$$

In the second embodiment, preferably the polymer B contains a polyester resin having a monomer unit derived from a polyhydric alcohol and a monomer unit derived from a polyvalent carboxylic acid, and when the SP value of the polyvalent carboxylic acid is $SP_{42}$ $(J/cm^3)^{0.5}$, preferably the following formula (4), or more preferably the following formula (4)' is satisfied.

$$0.0 \leq |(SP_{42}-SP_{22})| \leq 6.0 \quad (4)$$

$$0.0 \leq |(SP_{42}-SP_{22})| \leq 5.0 \quad (4)'$$

It is thought that if the difference in SP values is within this range, the polymer B exhibits a hydrophilicity close to that of the second monomer unit of the polymer A, and the polymer A and polymer B are more likely to be in close proximity. The writers believe that this reduces aggregate parts between first monomer units of the polymer A, thereby suppressing charge leakage.

A crosslinking agent may also be used to three-dimensionally crosslink the polyester resin of the polymer B. The crosslinking agent is not particularly limited, but is preferably a trivalent or higher polyvalent carboxylic acid, a trivalent or higher polyhydric alcohol, or a derivative of these.

Examples of the trivalent or higher polyhydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane and 1,3,5-trihydroxybenzene.

Examples of the trivalent or higher polyvalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, and anhydrides of these.

Of these, trimellitic acid and/or trimellitic acid anhydride is desirable because it is more reactive as a crosslinking agent and able to form a uniform crosslinked structure more easily.

The binder resin also preferably contains a tetrahydrofuran-insoluble component in the amount of at least 5 mass %, or more preferably at least 10 mass %. There is no particular upper limit, but preferably the content is not more than 40 mass %, or preferably not more than 20 mass %.

If the content of the THF-insoluble component in the binder resin is within this range, image density non-uniformity during fixing can be improved. This is thought to be because the insoluble component can be present throughout the toner particle, and thus the viscoelasticity of the toner can be maintained at a certain level or above at high temperatures. The amount of the THF-insoluble component can be controlled by controlling the crosslinking density of the polymer B.

In molecular weight distribution measurement of the tetrahydrofuran-soluble component of the toner, the weight average molecular weight is preferably at least 30,000, or more preferably at least 40,000. There is no particular upper limit, but preferably it is not more than 200,000, or more preferably not more than 100,000.

If the molecular weight is within this range, the first monomer unit in the polymer A becomes less compatible with the polymer B, resulting in good fixing irregularity because the toner as a whole melts uniformly when heated.

In viscoelasticity measurement of the tetrahydrofuran-soluble component of the toner, moreover, the storage elastic modulus Gk'(50) at 50° C. preferably conforms to the following formula (5):

$$Gk'(50) \geq 1.0 \times 10^7 \text{ Pa} \quad (5).$$

The Gk'(50) is more preferably at least $1.5 \times 10^7$ Pa, or still more preferably at least $2.0 \times 10^7$ Pa. There is no particular upper limit, but preferably it is not more than $1.0 \times 10^{10}$ Pa, or more preferably not more than $1.0 \times 10^9$ Pa.

If the Gk'(50) is within this range, the melting point and glass transition point of the toner are satisfactory, and storage stability is improved. The Gk'(50) can be controlled by controlling the molecular weight of the binder resin.

Moreover, in viscoelasticity measurement of the tetrahydrofuran-soluble component of the toner, the storage elastic modulus Gk'(100) at 100° C. preferably conforms to the following formula (6):

$$Gk'(100) \leq 1.0 \times 10^4 \text{ Pa} \quad (6).$$

The Gk'(100) is more preferably not more than $0.9\times10^4$ Pa, or still more preferably not more than $0.8\times10^4$ Pa. There is no particular lower limit, but preferably it is at least $1.0\times10^2$ Pa, or more preferably at least $1.0\times10^3$ Pa.

If the Gk'(100) is within this range, low-temperature fixability is good because the sharp-melt property is excellent. The Gk'(100) can be controlled by controlling the amount of the first monomer unit in the polymer A and the like.

In DSC measurement of the tetrahydrofuran-insoluble component of the toner, moreover, the endothermic quantity is preferably not more than 4.0 J/g, or more preferably not more than 3.5 J/g, or still more preferably not more than 2.0 J/g. There is no particular lower limit, but preferably it is at least 0 J/g. The lower the endothermic quantity the better. The endothermic quantity can be controlled by controlling the crosslinking density of the polymer A.

If the endothermic quantity of the tetrahydrofuran-insoluble component is within this range, developing performance is improved. This is thought to be because the first monomer unit in the polymer A becomes less compatible with the polymer B, allowing the charging performance to be maintained in a uniform state. Because the THF-insoluble component is no longer plasticized, moreover, image non-uniformity is reduced during fixing.

The materials other than the binder resin used in the toner particle are described in detail.

The toner may also be used as a magnetic toner containing a magnetic iron oxide particle. In this case, the magnetic iron oxide particle also serves as a colorant.

Examples of magnetic iron oxide particles include iron oxides such as magnetite, hematite and ferrite, metals such as iron, cobalt and nickel or alloys of these metals with other metals such as aluminum, cobalt, copper, lead, magnesium, tin, zinc, antimony, bismuth, calcium, manganese, titanium, tungsten and vanadium, and mixtures of these.

These magnetic iron oxide particles preferably have an average particle diameter of not more than 2 μm, or more preferably 0.05 μm to 0.5 μm. The content in the toner is preferably 20 to 200 mass parts, or more preferably 40 to 150 mass parts per 100 mass parts of the binder resin.

A colorant may also be used in the toner. Examples of the colorant are given below.

Carbon black, grafted carbon and blacks obtained by blending the yellow, magenta and cyan colorants below may be used as black colorants.

Typical examples of yellow colorants include condensed azo compounds, isoindolinone compounds, anthraquinone compounds, azo metal complexes, methine compounds and allylamide compounds. Examples of magenta colorants include condensed azo compounds, diketopyrrolopyrrole compounds, anthraquinone, quinacridone compounds, basic dye lake compounds, naphthol compounds, benzimidazolone compounds, thioindigo compounds and perylene compounds. Examples of cyan colorants include copper phthalocyanine compounds and their derivatives, anthraquinone compounds and basic dye lake compounds.

These colorants may be used individually, or in a mixture, or in a solid solution. The colorants are selected based on considerations of hue angle, chroma, lightness, weather resistance, OHP transparency, and dispersibility in the toner. The content of the colorant is preferably 1 to 20 mass parts per 100 mass parts of the binder resin.

A wax may also be included in the toner to impart release properties during fixing. Examples of this wax include polyolefin copolymers, aliphatic hydrocarbon waxes such as polyolefin wax, microcrystalline wax, paraffin wax and Fischer-Tropsch wax, and ester waxes and the like.

The content of the wax is preferably 1.0 to 30.0 mass parts per 100 mass parts of the binder resin.

A charge control agent may be included in the toner to stabilize the triboelectric charging properties. Examples of charge control agents include those that give the toner a negative charge and those that give the toner a positive charge, and one or two or more of a variety of charge control agents may be selected according to the type and use of the toner.

Examples of agents for giving the toner a negative charge include organic metal complexes (monoazo metal complexes, acetylacetone metal complexes), and metal salts or metal complexes of aromatic hydroxycarboxylic acids or aromatic dicarboxylic acids. Other examples include aromatic mono- and polycarboxylic acids and their metal salts and anhydrides; and esters and phenol derivatives such as bisphenol.

Examples of agents for giving the toner a positive charge include nigrosin and denatured products of fatty acid metal salts; quaternary ammonium salts such as tributylbenzylammonium-1-hydroxy-4-naphthosulfonate and tetrabutylammonium tetrafluoroborate, and derivatives of these; onium salts such as phosphonium salts, and lake pigments of these; triphenylmethane dyes and lake pigments thereof (with phosphotungstic acid, phosphomolybdic acid, phosphotungsten molybdic acid, tannic acid, lauric acid, gallic acid, ferricyanic acid or a ferrocyanic compound as the laking agent); and metal salts of higher fatty acids.

The method for manufacturing the toner particle is not particularly limited, and may be a pulverization method or a polymerization method such as emulsion polymerization, suspension polymerization or dissolution suspension for example.

From the standpoint of reducing density non-uniformity during fixing by maintaining viscoelasticity at high temperatures, a pulverization method is preferred because it allows components that are insoluble at high temperatures to be dispersed throughout the toner as a whole. Moreover, the toner manufacturing method preferably includes a step of melt kneading the polymer A.

In the pulverization method, first the polymer A for constituting the toner particle is thoroughly mixed together with as necessary, the polymer B, colorant, wax, charge control agent and other additives in a mixing apparatus such as a Henschel mixer or ball mill (mixing step). Next, the resulting mixture is melt kneaded with a heat-kneading apparatus such as a twin-screw kneading extruder, heating roll, kneader or extruder (melt kneading step). After cooling and solidifying, the melt kneaded product is pulverized (pulverization step), and classified as necessary. Thus, a toner particle can be obtained.

A step of melt kneading the polymer A and B while adding a crosslinking agent to crosslink the mixture is preferably included before the mixing step. Because part of the binder resin is insoluble at high temperatures, this makes it possible to increase viscoelasticity at high temperatures.

The toner particle may be used as is as a toner. It may also be thoroughly mixed with known additives as necessary in a mixing apparatus such as a Henschel mixer to obtain a toner.

An example of methods for calculating and measuring the various physical properties of the toner and toner materials in the present invention is described below.

Method for Measuring Contents of Monomer Units Derived from Each Polymerizable Monomer in the Polymer A The contents of the monomer units derived from each polymerizable monomer in the polymer A are measured by $^1$H-NMR under the following conditions.

| | |
|---|---|
| Measurement unit: | FT NMR unit JNM-EX400 (JEOL Ltd.) |
| Measurement frequency: | 400 MHz |
| Pulse condition: | 5.0 μs |
| Frequency range: | 10500 Hz |
| Number of integrations: | 64 |
| Measurement temperature: | 30° C. |
| Sample: | Prepared by placing 50 mg of the measurement sample in a sample tube with an inner diameter of 5 mm, adding deuterated chloroform ($CDCl_3$) as a solvent, and dissolving the mixture in a thermostatic tank at 40° C. |

Of the peaks attributable to constituent elements of the monomer unit derived from the first polymerizable monomer in the resulting $^1$H-NMR chart, a peak independent of peaks attributable to constituent elements of otherwise-derived monomer units is selected, and the integrated value $S_1$ of this peak is calculated. Similarly, a peak independent of peaks attributable to constituent elements of otherwise-derived monomer units is selected from the peaks attributable to constituent elements of the monomer unit derived from the second polymerizable monomer, and the integrated value $S_2$ of this peak is calculated.

When a third polymerizable monomer is used, a peak independent of peaks attributable to constituent elements of otherwise-derived monomer units is selected from the peaks attributable to constituent elements of the monomer unit derived from the third polymerizable monomer, and the integrated value $S_3$ of this peak is calculated.

The content of the monomer unit derived from the first polymerizable monomer is determined as follows using the integrated values $S_1$, $S_2$ and $S_3$. $n_1$, $n_2$ and $n_3$ are the numbers of hydrogen atoms in the constituent elements to which the observed peaks are attributed for each part.

$$\text{Ratio (mol \%) of monomer unit derived from first polymerizable monomer}=\{(S_1/n_1)/((S_1/n_1)+(S_2/n_2)+(S_3/n_3))\}\times 100$$

The monomer units derived from the second and third polymerizable monomers are determined in the same way as shown below.

$$\text{Ratio (mol \%) of monomer unit derived from second polymerizable monomer}=\{(S_2/n_2)/((S_1/n_1)+(S_2/n_2)+(S_3/n_3))\}\times 100$$

$$\text{Ratio (mol \%) of monomer unit derived from third polymerizable monomer}=\{(S_3/n_3)/((S_1/n_1)+(S_2/n_2)+(S_3/n_3))\}\times 100$$

When a polymerizable monomer not containing a hydrogen atom in a constituent element other than a vinyl group is used in the polymer A, measurement is performed in single pulse mode using $^{13}$C-NMR with $^{13}$C as the measured nucleus, and the ratio is calculated in the same way by $^1$H-NMR.

When the toner is manufactured by suspension polymerization, independent peaks may not be observed because the peaks of waxes and other resins overlap. It may thus not be possible to calculate the ratios of the monomer units derived from the polymerizable monomers in the polymer A. In this case, a polymer A' can be manufactured and analyzed as the polymer A by performing similar suspension polymerization without using a release agent or other resin.

Method for Measuring Storage Elastic Modulus

An "ARES" rotating flat plate rheometer (TA Instruments) is used as the measurement unit.

The toner is press-molded into a disk shape 8.0 mm in diameter and 2.0±0.3 mm thick at 25° C. in a tabletting machine for use as the measurement sample.

The sample is mounted on a parallel plate, and the temperature is raised from room temperature (25° C.) to 55° C. over the course of 15 minutes to shape the sample, which is then cooled to the initial temperature for viscoelasticity measurement, and measurement is initiated. It is important here that the sample be set so that the initial normal force is 0. Moreover, as discussed below, the effect of normal force is also cancelled out in subsequent measurement by automatic tension adjustment (Auto Tension Adjustment ON).

Measurement is performed under the following conditions.

(1) A parallel plate 7.9 mm in diameter is used.

(2) The frequency is 6.28 rad/sec (1.0 Hz).

(3) The initial applied strain (Strain) is set to 0.1%

(4) Measurement is performed at a ramp rate of 2.0° C./min between 30° C. and 200° C. Measurement is performed under the setting conditions of the following automatic adjustment mode. Measurement is performed in automatic strain adjustment mode (Auto Strain).

(5) Maximum strain (Max Applied Strain) is set to 20.0%.

(6) Maximum torque (Max Allowed Torque) is set to 200.0 g·cm, and minimum torque (Min Allowed Torque) to 0.2 g·cm.

(7) Strain Adjustment is set to 20.0% of Current Strain. Automatic tension adjustment mode (Auto Tension) is used during measurement.

(8) Auto Tension Direction is set to Compression.

(9) Initial Static Force is set to 10.0 g, and Auto Tension Sensitivity to 40.0 g.

(10) The operating condition for automatic tension (Auto Tension) is a Sample Modulus of at least $1.0\times10^3$ Pa.

When the THF-soluble component of the toner is used as the sample, the sample is prepared by the following methods.

1.5 g of toner for measuring storage elastic modulus is weighed exactly, placed in a cylindrical paper filter (Product name: No. 86R, 28×100 mm, Advantech Toyo Corp.), and set in a Soxhlet extractor.

This is extracted for 18 hours using 200 mL of tetrahydrofuran (THF) as the solvent, at a reflux rate at which the extraction cycle of the solvent is about once per 5 minutes.

After completion of extraction, the THF is removed from the extracted THF solution with an evaporator, and the remainder is vacuum dried for 8 hours at 40° C. to obtain a THF-soluble component. Using a tabletting machine in a 25° C. environment, the extracted THF-soluble component is press-molded into a disk 8.0 mm in diameter and 2.0±0.3 mm thick, and used as the sample.

Method for Calculating SP Value $SP_{12}$, $SP_{22}$, $SP_{32}$ and $SP_{42}$ are determined as follows following the calculation methods proposed by Fedors.

The evaporation energy (Δei) (cal/mol) and molar volume (Δvi) ($cm^3$/mol) are determined from the tables described in "Polym. Eng. Sci., 14(2), 147-154 (1974)" for the atoms or atomic groups in the molecular structures of each of the polymerizable monomers, and $(4.184\times\Sigma\Delta ei/\Sigma\Delta vi)^{0.5}$ is given as the SP value $(J/cm^3)^{0.5}$.

$SP_{11}$, $SP_{21}$, $SP_{31}$ and $SP_{41}$ are calculated by similar methods for the atoms or atomic groups in the molecular structures of the same polymerizable monomers with the double bonds cleaved by polymerization.

Method for Measuring Glass Transition Temperature Tg

The glass transition temperature Tg is measured according to ASTM D3418-82 using a "Q2000" differential scanning calorimeter (TA Instruments). The melting points of indium and zinc used for temperature correction of the device detection part, and the heat of fusion of indium is used for correction of the calorific value.

Specifically, about 2 mg of sample is weighed precisely and placed in an aluminumpan, and using an empty aluminum pan for reference, measurement is performed within a measurement temperature range of −10° C. to 200° C. at a ramp rats: of 10° C./min. For this measurement, the temperature is raised first to 200° C., then lowered to −10° C., and then raised again. A specific heat change is obtained in the range of 30° C. to 100° C. during this second temperature rise. The glass transition temperature Tg is the point of intersection between the differential thermal curve and a straight line drawn between the midpoints of the baselines before and after the specific heat change.

Measuring Weight Average Molecular Weight Mw (Measuring Molecular Weight Distribution of THF-Soluble Component of Toner)

The molecular weight (Mw) of the THF-soluble component of the polymer A is measured as follows by gel permeation chromatography (GPC).

First, the sample is dissolved in tetrahydrofuran (THF) over the course of 24 hours at room temperature. The resulting solution is filtered through a solvent-resistant membrane filter "Maishori Disk" (Tosoh Corp.) having a pore diameter of 0.2 μm to obtain a sample solution. The concentration of THF-soluble components in the sample solution is adjusted to about 0.8 mass %. Measurement is performed under the following conditions using this sample solution.

| | |
|---|---|
| System: | HLC8120 GPC (detector: RI) (Tosoh Corp.) |
| Columns: | Shodex KF-801, 802, 803, 804, 805, 806, 807 (7-coupled) (Showa Denko K.K.) |
| Eluent: | Tetrahydrofuran (THF) |
| Flow rate: | 1.0 mL/min |
| Oven temperature: | 40.0° C. |
| Sample injection volume: | 0.10 mL |

A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Melting Point

The melting points of the polymer A, release agent and the like are measured under the following conditions using a DSC Q1000 (TA Instruments).

| | |
|---|---|
| Ramp rate: | 10° C./min |
| Measurement start temperature: | 20° C. |
| Measurement end temperature: | 180° C. |

The melting points of indium and zinc are used for temperature correction of the device detection part, and the heat of fusion of indium is used for correction of the calorific value.

Specifically, 5 mg of sample is weighed precisely into an aluminum pan, and subjected to differential scanning calorimetry. An empty silver pan is used for reference.

The peak temperature of the maximum endothermic peak during the first temperature rise is given as the melting point.

When multiple peaks are present, the maximum endothermic peak is the peak at which the endothermic quantity is the greatest.

Method for Measuring Tetrahydrofuran (THF)-Insoluble Component 1.5 g of toner for measuring the THF-insoluble component (0.7 g when measuring the THF-insoluble component of the resin by itself) is weighed precisely ($W_1$g), placed in a pre-weighed cylindrical paper filter (Product name: No. 86R, 28×100 mm, Advantech Toyo Corp.), and set in a Soxhlet extractor.

This is extracted for 18 hours using 200 mL of tetrahydrofuran (THF) as the solvent, at a reflux rate at which the extraction cycle of the solvent is about once per 5 minutes.

After completion of extraction, the cylindrical filter is removed and air dried, and then vacuum dried for 8 hours at 40° C., the mass of the cylindrical filter including the extraction residue is weighed precisely, and the weight of the cylindrical filter is subtracted to calculate the mass ($W_2$g) of the extraction residue.

Next, the content of components other than resin components ($W_3$g) is determined by the following procedures ($W_3$ is 0 g when measuring the THF-insoluble component of the resin by itself).

About 2 g of the toner is weighed precisely ($W_a$g) into a pre-weighed 30 mL magnetic crucible.

The magnetic crucible is placed in an electric furnace and heated for about 3 hours at about 900° C., cooled in the electric furnace, and then left to cool for at least 1 hour in a dessicator at normal temperature, after which the mass of the crucible including the residual incineration ash is weighed, and the mass of the crucible is subtracted to calculate the residual incineration ash content ($W_b$g).

The mass ($W_3$g) of the residual incineration ash in the sample $W_1$g is then calculated by the following formula (A).

$$W_3 = W_1 \times (W_b / W_a) \quad \text{(A)}$$

In this case, the THF-insoluble component is determined by the following formula (B).

$$\text{THF-insoluble component (mass \%)} = \{(W_2 - W_3)/(W_1 - W_3)\} \times 100 \quad \text{(B)}$$

Measuring Endothermic Quantity of Tetrahydrofuran-Insoluble Component of Toner

The endothermic quantity of the tetrahydrofuran-insoluble component of the toner is measured under the following conditions using a DSC Q1000 (TA Instruments).

| | |
|---|---|
| Ramp rate: | 10° C./min |
| Measurement start temperature: | 20° C. |
| Measurement end temperature: | 180° C. |

The melting points of indium and zinc are used for temperature correction of the device detection part, and the heat of fusion of indium is used for correction of the calorific value.

Specifically, about 5 mg of the extraction residue described in the methods for measuring the THF-insoluble component is placed in an aluminum plan, and subjected to differential scanning calorimetry. An empty silver pan is used for reference. For this measurement, the temperature is raised first to 200° C., then lowered to 10° C., and then raised again. In a DSC curve obtained from this temperature rise process, the peak top temperature of the maximum endothermic peak in the temperature range of 10° C. to 200° C. is determined. The endothermic quantity (ΔH) of an endothermic peak is the integral value of that endothermic peak.

EXAMPLES

The present invention is explained in more detail below using examples and Comparative examples, but the invention is not in any way limited by these examples. Unless otherwise specified, the parts used in the examples are based on mass.

Manufacturing Example of Polymer A1

The following materials are added in a nitrogen atmosphere to a reactor equipped with a reflux condenser, a stirrer, a thermometer and a nitrogen introduction pipe.

| | |
|---|---|
| Solvent: Toluene | 100.0 parts |
| Monomer composition | 100.0 parts |
| (The monomer composition is a mixture of the following behenyl acrylate, methacrylonitrile and styrene in the following proportions) | |
| Behenyl acrylate (first polymerizable monomer) | 67.0 parts (28.9 mol %) |
| Methacrylonitrile (second polymerizable monomer) | 22.0 parts (53.8 mol %) |
| Styrene (third polymerizable monomer) | 11.0 parts (17.3 mol %) |
| t-butyl peroxypivalate (Perbutyl PV, NOF Corp.) | 3.0 parts |

The reactor contents are stirred at 200 rpm, heated to 70° C. and polymerized for 12 hours to obtain a solution of the polymers of the monomer composition dissolved in toluene. Next, this solution is cooled to 25° C., and added with stirring to 1,000.0 parts of methanol to precipitate a methanol-insoluble component. The resulting methanol-insoluble component is filtered out, washed with methanol, and vacuum dried for 24 hours at 40° C. to obtain a polymer A1. The polymer A1 had a weight average molecular weight of 20100, an acid value of 0.0 mg KOH/g, and a melting point of 62° C.

NMR analysis of this polymer A1 showed that it contained 28.9 mol % monomer units derived from behenyl acrylate, 53.8 mol % monomer units derived from methacrylonitrile and 17.3 mol % monomer units derived from styrene.

Preparation of Monomer Having Urethane Group 50.0 parts of methanol were loaded into a reactor, after which 5.0 parts of KarenzMOI (2-isocyanatoethyl methacrylate, Showa Denko) were added dropwise at 40° C. under stirring. After completion of dropping, this was stirred for 2 hours with the temperature maintained at 40° C. The unreacted methanol was then removed in an evaporator to prepare a monomer having a urethane group.

Preparation of Monomer Having Urea Group 50.0 parts of dibutylamine were loaded into a reactor, after which 5.0 parts of KarenzMOI (2-isocyanatoethyl methacrylate, Showa Denko) were added dropwise at 40° C. under stirring. After completion of dropping, this was stirred for 2 hours. The unreacted dibutylamine was then removed in an evaporator to prepare a monomer having a urea group.

Manufacturing Examples of Polymers A2 to A25

Polymers A2 to A25 were obtained by changing the monomer formulations from the manufacturing example of the polymer A1 as shown in Table 1. The physical properties of the polymers A1 to A25 are shown in Table 2.

TABLE 1

| Polymer A | | | A1 | A2 | A3 | A4 | A5 | A6 | A7 | A8 | A9 | A10 | A11 | A12 | A13 |
|---|---|---|---|---|---|---|---|---|---|---|---|---|---|---|---|
| Monomer formulation (parts) | First monomer unit | Behenyl acrylate | 67 | 40 | 89 | 61 | 40 | 34 | 67 | 50 | 60 | 60 | 65 | 61 | |
| | | Stearyl acrylate | | | | | | | | | | | | | 67 |
| | | Myricyl acrylate | | | | | | | | | | | | | |
| | | Octacosyl acrylate | | | | | | | | | | | | | |
| | | Hexadecyl acrylate | | | | | | | | | | | | | |
| | Second monomer unit | Acrylonitrile | | | | | | | 22 | | | | | | |
| | | Methacrylonitrile | 22 | 40 | 11 | 9 | 60 | 11 | | | | | | | 22 |
| | | Acrylic acid | | | | | | | | | | | | 9 | |
| | | HPMA | | | | | | | | 40 | | | | | |
| | | Vinyl acetate | | | | | | | | | 30 | | | | |
| | | Methyl acrylate | | | | | | | | | | 30 | | | |
| | | Acrylamide | | | | | | | | | | | 25 | | |
| | | UT | | | | | | | | | | | | | |
| | | UR | | | | | | | | | | | | | |
| | Third monomer unit | Styrene | 11 | 20 | | 30 | | 55 | 11 | 10 | 10 | 10 | 10 | | 11 |
| | | Methyl methacrylate | | | | | | | | | | | | 30 | |
| Total | | | 100 | 100 | 100 | 100 | 100 | 100 | 100 | 100 | 100 | 100 | 100 | 100 | 100 |

| Polymer A | | | A14 | A15 | A16 | A17 | A18 | A19 | A20 | A21 | A22 | A23 | A24 | A25 |
|---|---|---|---|---|---|---|---|---|---|---|---|---|---|---|
| Monomer formulation (parts) | First monomer unit | Behenyl acrylate | | | 63 | 63 | 47 | 40 | 40 | 66.6 | 90 | 61 | | 60 |
| | | Stearyl acrylate | | | | | 20 | | | | | | | |
| | | Myricyl acrylate | 67 | | | | | | | | | | | |
| | | Octacosyl acrylate | | 67 | | | | | | | | | | |
| | | Hexadecyl acrylate | | | | | | | | | | | 61 | |

TABLE 1-continued

| | | | | | | | | | | | | | | |
|---|---|---|---|---|---|---|---|---|---|---|---|---|---|---|
| | Second monomer unit | Acrylonitrile | | | | | | 27.5 | 27.5 | | | | | |
| | | Methacrylonitrile | 22 | 22 | 7 | 15 | 22 | | | | 10 | 7 | 26 | |
| | | Acrylic acid | | | 7 | 7 | | | | 4.8 | | | | |
| | | HPMA | | | | | | | | | | | | |
| | | Vinyl acetate | | | | | | | | | | | | |
| | | Methyl acrylate | | | | | | | | | | | | |
| | | Acrylamide | | | | | | | | | | | | |
| | | UT | | | | | | 2.5 | | | | | | |
| | | UR | | | | | | | 2.5 | | | | | |
| | Third monomer unit | Styrene | 11 | 11 | 23 | 15 | 11 | 30 | 30 | | | 32 | 13 | 11 |
| | | Methyl methacrylate | | | | | | | | 28.6 | | | | 29 |
| | Total | | 100 | 100 | 100 | 100 | 100 | 100 | 100 | 100 | 100 | 100 | 100 | 100 |

15

The abbreviations in Tables 1 and 2 are defined as follows.
HPMA: 2-hydroxypropyl methacrylate
UT: Monomer having urethane group
UR: Monomer having urea group

TABLE 2

| Polymer A | | | A1 | A2 | A3 | A4 | A5 | A6 | A7 |
|---|---|---|---|---|---|---|---|---|---|
| Mol % | First monomer | Behenyl acrylate | 28.9 | 11.8 | 58.8 | 27.5 | 10.5 | 11.4 | 25.3 |
| | | Stearyl acrylate | | | | | | | |
| | | Myricyl acrylate | | | | | | | |
| | | Octacosyl acrylate | | | | | | | |
| | | Hexadecyl acrylate | | | | | | | |
| | Second monomer | Acrylonitrile | | | | | | | 59.5 |
| | | Methacrylonitrile | 53.8 | 66.7 | 41.2 | 23 | 89.5 | 21 | |
| | | Acrylic acid | | | | | | | |
| | | HPMA | | | | | | | |
| | | Vinyl acetate | | | | | | | |
| | | Methyl acrylate | | | | | | | |
| | | Acrylamide | | | | | | | |
| | | UT | | | | | | | |
| | | UR | | | | | | | |
| | Third monomer | Styrene | 17.3 | 21.5 | | 49.5 | | 67.6 | 15.2 |
| | | Methyl methacrylate | | | | | | | |
| | Total | | 100 | 100 | 100 | 100 | 100 | 100 | 100 |
| Physical properties | SP value | $SP_{21} - SP_{11}$ | 7.71 | 7.71 | 7.71 | 7.71 | 7.71 | 7.71 | 11.19 |
| | | $SP_{22} - SP_{12}$ | 4.28 | 4.28 | 4.28 | 4.28 | 4.28 | 4.28 | 5.05 |
| | Melting point | Tm (° C.) | 62 | 55 | 62 | 57 | 56 | 53 | 62 |
| | Molecular weight | Mw | 20100 | 18500 | 19400 | 19000 | 19600 | 19000 | 19700 |

| Polymer A | | | A8 | A9 | A10 | A11 | A12 | A13 |
|---|---|---|---|---|---|---|---|---|
| Mol % | First monomer | Behenyl acrylate | 26 | 26.2 | 26.2 | 27.6 | 27.4 | |
| | | Stearyl acrylate | | | | | | 32.3 |
| | | Myricyl acrylate | | | | | | |
| | | Octacosyl acrylate | | | | | | |
| | | Hexadecyl acrylate | | | | | | |
| | Second monomer | Acrylonitrile | | | | | | |
| | | Methacrylonitrile | | | | | | 51.2 |
| | | Acrylic acid | | | | | 21.4 | |
| | | HPMA | 55 | | | | | |
| | | Vinyl acetate | | 57.9 | | | | |
| | | Methyl acrylate | | | 57.9 | | | |
| | | Acrylamide | | | | 56.9 | | |
| | | UT | | | | | | |
| | | UR | | | | | | |
| | Third monomer | Styrene | 19 | 15.9 | 15.9 | 15.5 | | 16.5 |
| | | Methyl methacrylate | | | | | 51.2 | |
| | Total | | 100 | 100 | 100 | 100 | 100 | 100 |
| Physical properties | SP value | $SP_{21} - SP_{11}$ | 5.87 | 3.35 | 3.35 | 21.01 | 10.47 | 7.57 |
| | | $SP_{22} - SP_{12}$ | 4.36 | 0.61 | 0.61 | 11.43 | 4.97 | 4.25 |
| | Melting point | Tm (° C.) | 59 | 56 | 54 | 59 | 57 | 54 |
| | Molecular weight | Mw | 19900 | 19000 | 19500 | 18800 | 18500 | 19500 |

TABLE 2-continued

| Polymer A | | | A14 | A15 | A16 | A17 | A18 | A19 |
|---|---|---|---|---|---|---|---|---|
| Mol % | First monomer | Behenyl acrylate | | | 28.2 | 26.3 | 20 | 11.4 |
| | | Stearyl acrylate | | | | | 10 | |
| | | Myricyl acrylate | 23.9 | | | | | |
| | | Octacosyl acrylate | | 25 | | | | |
| | | Hexadecyl acrylate | | | | | | |
| | Second monomer | Acrylonitrile | | | | | | 56 |
| | | Methacrylonitrile | 57.6 | 56.8 | 17.7 | 35.5 | 53 | |
| | | Acrylic acid | | | 16.5 | 15.4 | | |
| | | HPMA | | | | | | |
| | | Vinyl acetate | | | | | | |
| | | Methyl acrylate | | | | | | |
| | | Acrylamide | | | | | | |
| | | UT | | | | | | 1.4 |
| | | UR | | | | | | |
| | Third monomer | Styrene | 18.5 | 18.2 | 37.6 | 22.8 | 17 | 31.2 |
| | | Methyl methacrylate | | | | | | |
| | Total | | 100 | 100 | 100 | 100 | 100 | 100 |
| Physical properties | SP value | $SP_{21} - SP_{11}$ | 7.88 | 7.85 | 7.71<br>10.47 | 7.71<br>10.47 | 7.67 | 11.19<br>5.54 |
| | | $SP_{22} - SP_{12}$ | 4.32 | 4.32 | 4.28<br>4.97 | 4.28<br>4.97 | 4.27 | 5.05<br>4.21 |
| | Melting point | Tm (° C.) | 76 | 78 | 58 | 61 | 58 | 55 |
| | Molecular weight | Mw | 18500 | 19000 | 19900 | 19000 | 19400 | 18800 |

| Polymer A | | | A20 | A21 | A22 | A23 | A24 | A25 |
|---|---|---|---|---|---|---|---|---|
| Mol % | First monomer | Behenyl acrylate | 11.4 | 33.2 | 61.3 | 28 | | 28.5 |
| | | Stearyl acrylate | | | | | | |
| | | Myricyl acrylate | | | | | | |
| | | Octacosyl acrylate | | | | | | |
| | | Hexadecyl acrylate | | | | | 28.6 | |
| | Second monomer | Acrylonitrile | 56.3 | | | | | |
| | | Methacrylonitrile | | | 38.7 | 18.2 | 54 | |
| | | Acrylic acid | | 12.6 | | | | |
| | | HPMA | | | | | | |
| | | Vinyl acetate | | | | | | |
| | | Methyl acrylate | | | | | | |
| | | Acrylamide | | | | | | |
| | | UT | | | | | | |
| | | UR | 1 | | | | | |
| | Third monomer | Styrene | 31.3 | | | 53.8 | 17.4 | 19.1 |
| | | Methyl methacrylate | | 54.2 | | | | 52.4 |
| | Total | | 100 | 100 | 100 | 100 | 100 | 100 |
| Physical properties | SP value | $SP_{21} - SP_{11}$ | 11.19<br>3.50 | 10.47 | 7.71 | 7.71 | 7.49 | 2.07 |
| | | $SP_{22} - SP_{12}$ | 5.05<br>3.17 | 4.97 | 4.28 | 4.28 | 4.23 | 0.57 |
| | Melting point | Tm (° C.) | 55 | 56 | 62 | 56 | 45 | 52 |
| | Molecular weight | Mw | 20000 | 21200 | 22400 | 20600 | 22200 | 21300 |

Manufacturing Example of Polymer B1

| | |
|---|---|
| Bisphenol A propylene oxide adduct (2.0 mol adduct) | 30.0 parts |
| Bisphenol A ethylene oxide adduct (2.0 mol adduct) | 15.0 parts |
| Terephthalic acid | 33.0 parts |
| Adipic acid | 15.0 parts |
| Trimellitic acid | 7.0 parts |

This polyester monomer mixture was loaded into a 5-liter autoclave, and 0.05 mass % of tetraisobutyl titanate was added relative to the total amount of the polyester monomer mixture. A reflux condenser, moisture separator, nitrogen gas introduction pipe, thermometer and stirrer were attached, and nitrogen gas was introduced into the autoclave as a polycondensation reaction was performed at 230° C. The reaction time was adjusted so as to obtain the molecular weight shown in Table 4. After completion of the reaction the contents were removed from the vessel, cooled, and pulverized to obtain a polymer B1. The resulting polymer B1 had a weight average molecular weight of Mw 45,000 and a Tg of 62° C.

Manufacturing Examples of Polymer B2 to B5

Polymers B2 to B5 were obtained by changing the monomer formulations from the manufacturing example of the polymer B1 as shown in Table 3. The physical properties of the polymers B2 to B5 are shown in Table 4.

TABLE 3

| | Polymer B | B1 | B2 | B3 | B4 | B5 |
|---|---|---|---|---|---|---|
| Alcohol | Bisphenol A propylene oxide 2.0 mol adduct | 30 | 45 | 20 | 30 | 15 |
| | Bisphenol A ethylene oxide 2.0 mol adduct | 15 | | 25 | 15 | 30 |
| Acid | Terephthalic acid | 33 | 31 | 33 | 31 | 42 |
| | Adipic acid | 15 | 15 | 15 | 14 | 10 |
| | Trimellitic acid | 7 | 9 | | 10 | |
| | 1,2,6-hexanetricarboxylic acid | | | 7 | | 3 |
| | Total | 100 | 100 | 100 | 100 | 100 |

TABLE 4

| | Polymer B | B1 | B2 | B3 | B4 | B5 | B6 | B7 | B8 |
|---|---|---|---|---|---|---|---|---|---|
| Physical properties | Molecular weight Mw | 45000 | 32000 | 24000 | 18000 | 25000 | 21000 | 18000 | 28000 |
| | Glass transition temperature Tg (° C.) | 62 | 64 | 60 | 59 | 59 | 58 | 57 | 55 |
| | THF-insoluble component (mass %) | 40 | 50 | 30 | 25 | 20 | 35 | 35 | 15 |

Manufacturing Example of Polymer B6

| | |
|---|---|
| Bisphenol A ethylene oxide adduct (2.0 mol adduct) | 30.0 parts |
| Bisphenol A propylene oxide adduct (2.0 mol adduct) | 28.0 parts |
| Terephthalic acid | 30.0 parts |
| Trimellitic anhydride | 7.0 parts |
| Acrylic acid | 5.0 parts |

These polyester monomers were loaded into a 4-necked flask, a pressure reducer, moisture separator, nitrogen gas introduction device, temperature gauge and stirrer were attached, and the mixture was stirred at 160° C. in a nitrogen atmosphere. A mixture of 40 parts of vinyl polymerizing monomers (styrene: 60.0 parts, 2-ethylhexyl acrylate: 40.0 parts) for constituting vinyl polymer segments and 2.0 parts of benzoyl peroxide as a polymerization initiator was then added dropwise through a drop funnel over the course of 4 hours. This was then reacted for 5 hours at 160° C., the temperature was raised to 230° C., 0.05 mass % of tetraisobutyl titanate was added, and the reaction time was adjusted to obtain the molecular weight shown in Table 4. After completion of the reaction this was removed from the reactor, cooled, and pulverized to obtain a polymer B6. The physical properties of the resulting polymer B6 are shown in Table 4.

Manufacturing Example of Polymer B7

| | |
|---|---|
| Bisphenol A ethylene oxide adduct (2.0 mol adduct) | 30.0 parts |
| Bisphenol A propylene oxide adduct (2.0 mol adduct) | 28.0 parts |
| Terephthalic acid | 30.0 parts |
| Trimellitic anhydride | 7.0 parts |
| Acrylic acid | 5.0 parts |

These polyester monomers were loaded into a 4-necked flask, a pressure reducer, moisture separator, nitrogen gas introduction device, temperature gauge and stirrer were attached, and the mixture was stirred at 160° C. in a nitrogen atmosphere. A mixture of 40 parts of vinyl polymerizing monomers (styrene: 60.0 parts, 2-ethylhexyl acrylate: 40.0 parts) for constituting vinyl polymer segments and 2.0 parts of benzoyl peroxide as a polymerization initiator was then added dropwise through a drop funnel over the course of 4 hours. This was then reacted for 5 hours at 160° C., the temperature was raised to 230° C., 0.05 mass % of tetraisobutyl titanate was added, and the reaction time was adjusted to obtain the molecular weight shown in Table 4. After completion of the reaction this was removed from the reactor, cooled, and pulverized to obtain a polymer B7. The physical properties of the resulting polymer B7 are shown in Table 4.

Manufacturing Example of Polymer B8

300 parts of xylene were loaded into a 4-necked flask, the inside of the container was thoroughly purged with nitrogen under stirring, and the temperature was raised to reflux.

| | |
|---|---|
| Styrene | 78.0 parts |
| N-butyl acrylate | 21.0 parts |
| Divinyl benzene | 1.0 parts |

The above mixture was added dropwise over the course of 4 hours under reflux, and maintained for 2 hours to complete polymerization and obtain a solution of a polymer B8. The organic solvent was distilled off from this solution, and the resulting resin was cooled and solidified and then pulverized to obtain a polymer B8. The physical properties of the polymer B8 are shown in Table 4.

Manufacturing Example of Polymer A26

| | |
|---|---|
| Polymer A1: | 70.0 parts |
| Polymer B1: | 30.0 parts |

These materials were pre-mixed in an FM mixer (Nippon Coke & Engineering), and supplied to a twin-screw extruder (Ikegai Iron Works, PCM-30) at a rate of 10 kg/hour. At the same time, t-butyl peroxypivalate (Perbutyl PV, NOF Corp.) was supplied at a rate of 0.20 kg/hour to perform a cross-linking reaction. The resulting resin was cooled, solidified and then pulverized to obtain a polymer A26.

Manufacturing Example of Polymer A27

The polymer A5 was substituted for the polymer A1 in the manufacturing example of the polymer 26 to obtain a polymer A27.

Manufacturing Example of Polymer A28

The polymer A6 was substituted for the polymer A1 in the manufacturing example: of the polymer 26 to obtain a polymer A28.

Manufacturing Example of Toner Particle 1

| | |
|---|---|
| Polymer A1: | 60.0 parts |
| Polymer B1: | 40.0 parts |
| Spherical magnetic iron oxide particle (number-average particle diameter of primary particle: 0.20 μm, Hc = 6.0 kA/m, σs = 85.2 $Am^2/kg$, σr = 6.5 $Am^2/kg$): | 95.0 parts |
| C105 (Sasol): | 4.0 parts |
| T-77 (Hodogaya Chemical Co.): | 2.0 parts |

These materials were pre-mixed in an FM mixer (Nippon Coke & Engineering), and then melt kneaded in a twin-screw extruder (Ikegai Iron Works PCM-30).

The kneaded product was cooled, coarsely pulverized in a hammer mill, and then pulverized in a mechanical pulverizer (Turbo Kogyo T-250), and the resulting finely pulverized powder was classified with a multi-division classifier using the Coanda effect to obtain a negatively chargeable toner particle 1 with a weight average particle diameter (D4) of 7.5 μm.

Manufacturing Example of Toner 1

| | |
|---|---|
| Toner particle 1: | 100 parts |
| Hydrophobic silica fine power (number-average particle diameter of primary particle: 10 nm, BET specific surface area of primary silica: 200 $m^2/g$) | 1 part |

These materials were externally added and mixed in an FM mixer (Nippon Coke & Engineering) to obtain a toner 1. The physical properties of the toner 1 are shown in Table 5.

Manufacturing Examples of Toners 2 to 32

Toner particles 2 to 32 were obtained by changing the materials used in the manufacturing example of toner particle 1 as shown in Table 6. Toners 2 to 32 were then obtained as in the manufacturing example of toner 1 except that the toner particle was changed.

TABLE 5

| Toner No. | Gt'(150) ($\times 10^4$ Pa) | $\lvert SP_{41} - SP_{21} \rvert$ | $\lvert SP_{42} - SP_{22} \rvert$ | Content of THF-insoluble component (%) | Weight average molecular weight of THF-soluble component | Gk'(50) ($\times 10^7$ Pa) | Gk'(100) ($\times 10^4$ Pa) | Endothermic quantity of THF-insoluble component (J/g) |
|---|---|---|---|---|---|---|---|---|
| 1 | 3.0 | 2.8 | 1.2 | 16 | 43000 | 2.5 | 0.60 | 0 |
| 2 | 5.0 | 2.8 | 1.2 | 12 | 42000 | 2.5 | 0.80 | 0 |
| 3 | 5.0 | 2.8 | 1.2 | 20 | 42000 | 2.5 | 0.50 | 0 |
| 4 | 3.0 | 2.8 | 1.2 | 12 | 42000 | 2.5 | 0.65 | 0 |
| 5 | 3.0 | 2.8 | 1.2 | 12 | 42000 | 2.5 | 0.90 | 0 |
| 6 | 3.0 | 2.8 | 1.2 | 12 | 42000 | 2.5 | 0.80 | 0 |
| 7 | 3.0 | 6.2 | 0.4 | 12 | 42000 | 2.5 | 0.60 | 0 |
| 8 | 3.0 | 0.9 | 1.1 | 12 | 42000 | 2.5 | 0.60 | 0 |
| 9 | 3.0 | 1.6 | 4.9 | 12 | 42000 | 2.5 | 0.60 | 0 |
| 10 | 3.0 | 1.6 | 4.9 | 12 | 42000 | 2.5 | 0.60 | 0 |
| 11 | 3.0 | 16.1 | 5.9 | 12 | 42000 | 2.5 | 0.65 | 0 |
| 12 | 3.0 | 5.5 | 0.5 | 12 | 42000 | 2.5 | 0.65 | 0 |
| 13 | 3.0 | 2.8 | 1.2 | 12 | 42000 | 2.5 | 0.60 | 0 |
| 14 | 3.0 | 2.8 | 1.2 | 12 | 42000 | 2.5 | 0.60 | 0 |
| 15 | 3.0 | 2.8 | 1.2 | 12 | 42000 | 2.5 | 0.60 | 0 |
| 16 | 3.0 | 2.8 | 1.2 | 12 | 42000 | 2.5 | 0.65 | 0 |
| 17 | 3.0 | 2.8 | 1.2 | 12 | 42000 | 2.5 | 0.65 | 0 |
| 18 | 3.0 | 2.8 | 1.2 | 12 | 42000 | 2.5 | 0.55 | 0 |
| 19 | 3.0 | 0.6 | 1.3 | 12 | 42000 | 2.5 | 0.80 | 0 |
| 20 | 3.0 | 1.5 | 2.3 | 12 | 43000 | 2.5 | 0.80 | 0 |
| 21 | 1.9 | 2.8 | 1.2 | 8 | 31000 | 1.8 | 0.55 | 0 |
| 22 | 1.6 | 2.8 | 1.2 | 12 | 21000 | 1.5 | 0.65 | 0 |
| 23 | 3.0 | 2.8 | 1.2 | 16 | 43000 | 2.5 | 0.65 | 0 |
| 24 | 3.0 | 2.8 | 1.2 | 18 | 41000 | 2.8 | 0.75 | 3.4 |
| 25 | 3.0 | 2.8 | 1.2 | 12 | 41000 | 3.2 | 0.65 | 4.2 |
| 26 | 3.0 | 2.8 | 1.2 | 12 | 41000 | 2.5 | 0.95 | 4.2 |
| 27 | 3.0 | 2.8 | 1.2 | 12 | 41000 | 2.5 | 1.20 | 4.2 |
| 28 | 1.5 | 7.4 | 3.4 | 11 | 24000 | 1.5 | 0.60 | 0 |
| 29 | 1.1 | 7.4 | 3.4 | 11 | 18000 | 1.5 | 0.60 | 0 |
| 30 | 1.4 | 2.8 | 1.2 | 8 | 43000 | 2.5 | 0.60 | 0 |
| 31 | 1.2 | 2.8 | 1.2 | 5 | 43000 | 2.5 | 0.55 | 0 |
| 32 | 1.3 | 2.8 | 1.2 | 5 | 43000 | 2.5 | 0.60 | 0 |
| Comparative 1 | 0.8 | 5.5 | 0.5 | 4 | 42000 | 1.4 | 0.65 | 0 |
| Comparative 2 | 1.8 | 5.5 | 0.5 | 13 | 42000 | 1.4 | 0.65 | 0 |
| Comparative 3 | 3.0 | 2.8 | 1.2 | 10 | 41000 | 2.5 | 0.50 | 0 |
| Comparative 4 | 3.0 | 2.8 | 1.2 | 6 | 41000 | 2.5 | 0.60 | 0 |
| Comparative 5 | 3.0 | 2.8 | 1.2 | 6 | 41000 | 2.5 | 0.60 | 0 |
| Comparative 6 | 3.0 | 2.9 | 4.9 | 6 | 41000 | 1.5 | 0.60 | 0 |
| Comparative 7 | 0.8 | 2.8 | 1.2 | 4 | 21000 | 2.5 | 0.55 | 0 |

TABLE 6

| Toner No. | Polymer A | | Polymer B | | Wax | | Colorant | | Charge control agent | |
|---|---|---|---|---|---|---|---|---|---|---|
| 1 | A1 | 60 | B1 | 40 | C105 | 4 | Mo | 95 | T77 | 2 |
| 2 | A2 | 70 | B1 | 30 | C105 | 4 | Mo | 95 | T77 | 2 |
| 3 | A3 | 50 | B1 | 50 | C105 | 4 | Mo | 95 | T77 | 2 |
| 4 | A4 | 70 | B1 | 30 | C105 | 4 | Mo | 95 | T77 | 2 |
| 5 | A5 | 70 | B1 | 30 | C105 | 4 | Mo | 95 | T77 | 2 |
| 6 | A6 | 70 | B1 | 30 | C105 | 4 | Mo | 95 | T77 | 2 |
| 7 | A7 | 70 | B1 | 30 | C105 | 4 | Mo | 95 | T77 | 2 |
| 8 | A8 | 70 | B1 | 30 | C105 | 4 | Mo | 95 | T77 | 2 |
| 9 | A9 | 70 | B1 | 30 | C105 | 4 | Mo | 95 | T77 | 2 |
| 10 | A10 | 70 | B1 | 30 | C105 | 4 | Mo | 95 | T77 | 2 |
| 11 | A11 | 70 | B1 | 30 | C105 | 4 | Mo | 95 | T77 | 2 |
| 12 | A12 | 70 | B1 | 30 | C105 | 4 | Mo | 95 | T77 | 2 |
| 13 | A13 | 70 | B1 | 30 | C105 | 4 | Mo | 95 | T77 | 2 |
| 14 | A14 | 70 | B1 | 30 | C105 | 4 | Mo | 95 | T77 | 2 |
| 15 | A15 | 70 | B1 | 30 | C105 | 4 | Mo | 95 | T77 | 2 |
| 16 | A16 | 70 | B1 | 30 | C105 | 4 | Mo | 95 | T77 | 2 |
| 17 | A17 | 70 | B1 | 30 | C105 | 4 | Mo | 95 | T77 | 2 |
| 18 | A18 | 70 | B1 | 30 | C105 | 4 | Mo | 95 | T77 | 2 |
| 19 | A19 | 70 | B1 | 30 | C105 | 4 | Mo | 95 | T77 | 2 |
| 20 | A20 | 70 | B1 | 30 | C105 | 4 | Mo | 95 | T77 | 2 |
| 21 | A1 | 80 | B2 | 20 | C105 | 4 | Mo | 95 | T77 | 2 |
| 22 | A1 | 60 | B3 | 40 | C105 | 4 | Mo | 95 | T77 | 2 |
| 23 | A1 | 60 | B1 | 40 | C105 | 4 | CB | 10 | T77 | 2 |
| 24 | A26 | 80 | B1 | 20 | C105 | 4 | Mo | 95 | T77 | 2 |
| 25 | A26 | 100 | — | 0 | C105 | 4 | Mo | 95 | T77 | 2 |
| 26 | A27 | 100 | — | 0 | C105 | 4 | Mo | 95 | T77 | 2 |
| 27 | A28 | 100 | — | 0 | C105 | 4 | Mo | 95 | T77 | 2 |
| 28 | A1 | 70 | B6 | 30 | C105 | 4 | Mo | 95 | T77 | 2 |
| 29 | A1 | 70 | B7 | 30 | C105 | 4 | Mo | 95 | T77 | 2 |
| 30 | A1 | 80 | B7 | 20 | C105 | 4 | Mo | 95 | T77 | 2 |
| 31 | A1 | 80 | B7 | 20 | C105 | 4 | Mo | 95 | T77 | 2 |
| 32 | A1 | 60 | B8 | 40 | C105 | 4 | Mo | 95 | T77 | 2 |
| Comparative 1 | A21 | 70 | B4 | 30 | C105 | 4 | Mo | 95 | T77 | 2 |
| Comparative 2 | A21 | 30 | B5 | 70 | C105 | 4 | Mo | 95 | T77 | 2 |
| Comparative 3 | A22 | 50 | B1 | 50 | C105 | 4 | Mo | 95 | T77 | 2 |
| Comparative 4 | A23 | 70 | B1 | 30 | C105 | 4 | Mo | 95 | T77 | 2 |
| Comparative 5 | A24 | 70 | B1 | 30 | C105 | 4 | Mo | 95 | T77 | 2 |
| Comparative 6 | A25 | 70 | B1 | 30 | C105 | 4 | Mo | 95 | T77 | 2 |
| Comparative 7 | A1 | 80 | B3 | 20 | C105 | 4 | Mo | 95 | T77 | 2 |

In the table, Mo denotes "magnetic iron oxide", and CB denotes "carbon black". Amounts of the materials in the table represent parts.

Manufacturing Examples of Comparative Toners 1 to 7

Comparative toner particles 1 to 7 were obtained by changing the materials used in the manufacturing example of toner particle 1 as shown in Table 6. Comparative toners 1 to 7 were then obtained as in the manufacturing example of toner 1 except that the toner particle was changed.

Example 1

The evaluation apparatus used in these examples is a commercial HP LaserJet Enterprise M609dn magnetic one-component printer (Hewlett Packard: process speed 420 mm/s). The toner 1 was evaluated as shown below using this printer. Vitality (Xerox, basis weight 75 g/cm$^2$, letter size) was used as the evaluation paper. The evaluation results are shown in Table 7.

Examples 2 to 32

Evaluations were performed as in Example 1 using the toners 2 to 32. Because the toner 23 is not magnetic, it was evaluated using a Color Laser Jet CP4525 commercial color printer (HP). The evaluation results are shown in Table 7.

Comparative Examples 1 to 7

Evaluations were performed as in Example 1 using the comparative toners 1 to 7. The evaluation results for the Comparative examples 1 to 7 are shown in Table 7.

Evaluation of Low-Temperature Fixability

To evaluate low-temperature fixability, the fixing unit was removed from the modified evaluation apparatus, modified so that the temperature could be set at will, and given a process speed of 520 mm/sec to obtain a modified external fixing unit. Using this unit, the temperature was controlled in 5° C. increments in the range of 120° C. to 180° C., and half-tone images were output with an image density of 0.60 to 0.65. The resulting images were rubbed back and forth 5 times with Silbon paper under a load of 4.9 kPa, and the rate of image density decrease after rubbing was measured.

The set temperature of the fixing unit was plotted on the horizontal axis and the density decrease rate on the vertical axis of the coordinate plane, all plots were connected with straight lines, and low-temperature fixability was evaluated according to the following standard with the fixing temperature of the fixing unit at an image decrease rate of 10% given as the fixing initiation temperature of the toner. The low-temperature fixability evaluation was performed in a low-temperature, low humidity environment (7.5° C./15% RH), which is disadvantageous for heat-fixing toner. A score of C or more is considered good.

Evaluation Standard

A: Fixing onset temperature less than 145° C.

B: Fixing onset temperature 145° C. or more and less than 150° C.

C: Fixing onset temperature 150° C. or more and less than 155° C.

D: Fixing onset temperature at least 155° C.

Evaluation of Image Non-Uniformity 100 prints of an overall solid image were output as a sample image continuously in a normal temperature, normal humidity environment (23° C., 60% RH), and the final 5 prints were taken. 9 points were selected equally from the total solid. image density of the resulting images, and reflected density was measured using a Macbeth reflection densitometer Macbeth) with an SPI filter. The difference was calculated from the maximum value and the minimum value of the 9 points, and image non-uniformity during fixing was evaluated based on the average difference of 5 prints. A score of C or better is considered good.

Evaluation Standard

A: Less than 0.04

B: 0.04 or more and less than 0.06

C: 0.06 or more and less than 0.08

D: At least 0.08

Evaluation of Initial Developing Performance 5 prints of an overall solid image were output as a sample image in a normal temperature, normal humidity environment (23° C., 60% RH). The reflection density of 1 point in the center of the resulting overall solid image was measured with a Macbeth densitometer (Macbeth) using an SPI filter, and the initial developing performance was evaluated based on the average density of the 5 prints. A score of C or better is considered good.

Evaluation Standard

A: At least 1.25

B: 1.15 or more and less than 1.25

C: 1.05 or more and less than 1.15

D: Less than 1.05

Evaluation of Storability 10 g of toner was weighed into 50 mL resin cups, and each was left for 3 days in one of 6 thermostatic tanks with temperatures differing by 2° C. beginning with 50° C. After 3 days the toner was observed visually, and storability was evaluated based on the highest temperature at which toner lumps got smaller and broke up when the cup was turned. A score of C or better is considered good.

Evaluation Standard

A: At least 58° C.

B: 54° C. or more and less than 58° C.

C: 50° C. or more and less than 54° C.

D: Less than 50° C.

In the table, C.E. denotes Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113067, filed Jun. 13, 2018, and Japanese Patent Application No. 2019-074943, filed Apr. 10, 2019, which are hereby incorporated by reference herein in their entirety.

What is claimed is:

1. A toner, comprising:

a toner particle containing a binder resin, the binder resin containing a crystalline resin consisting of a polymer A having a first, second and third monomer units respectively derived from a first, second and third monomer units that are mutually different from each other, wherein a content of the first monomer unit in the polymer A is 5.0 to 60.0 mol % of the total moles of all monomer units in the polymer A, a content of the second monomer unit in the polymer A is 20.0 to 95.0 mol % of the total moles of all monomer units in the polymer A, a storage elastic modulus Gt' (150) of the toner at 150° C. is at least $1.0\times10^4$ Pa,

TABLE 7

| Example No. | Toner No. | Storability | | Low-temperature fixability | | Fixing non-uniformity | | Initial developing performance | |
|---|---|---|---|---|---|---|---|---|---|
| 1 | 1 | 60° C. | A | 144° C. | A | 0.02 | A | 1.30 | A |
| 2 | 2 | 56° C. | B | 141° C. | A | 0.02 | A | 1.30 | A |
| 3 | 3 | 60° C. | A | 137° C. | A | 0.02 | A | 1.10 | C |
| 4 | 4 | 56° C. | B | 144° C. | A | 0.02 | A | 1.20 | B |
| 5 | 5 | 56° C. | B | 153° C. | C | 0.02 | A | 1.30 | A |
| 6 | 6 | 52° C. | C | 153° C. | C | 0.02 | A | 1.30 | A |
| 7 | 7 | 60° C. | A | 141° C. | A | 0.02 | A | 1.16 | B |
| 8 | 8 | 56° C. | B | 139° C. | A | 0.02 | A | 1.20 | B |
| 9 | 9 | 54° C. | B | 138° C. | A | 0.02 | A | 1.20 | B |
| 10 | 10 | 52° C. | C | 137° C. | A | 0.02 | A | 1.20 | B |
| 11 | 11 | 56° C. | B | 145° C. | B | 0.02 | A | 1.07 | C |
| 12 | 12 | 56° C. | B | 144° C. | A | 0.02 | A | 1.18 | B |
| 13 | 13 | 52° C. | C | 141° C. | A | 0.02 | A | 1.20 | B |
| 14 | 14 | 60° C. | A | 153° C. | C | 0.02 | A | 1.20 | B |
| 15 | 15 | 60° C. | A | 154° C. | C | 0.02 | A | 1.20 | B |
| 16 | 16 | 56° C. | B | 141° C. | A | 0.02 | A | 1.20 | B |
| 17 | 17 | 60° C. | A | 141° C. | A | 0.02 | A | 1.20 | B |
| 18 | 18 | 56° C. | B | 141° C. | A | 0.02 | A | 1.10 | C |
| 19 | 19 | 52° C. | C | 150° C. | C | 0.02 | A | 1.27 | A |
| 20 | 20 | 50° C. | C | 151° C. | C | 0.02 | A | 1.30 | A |
| 21 | 21 | 60° C. | A | 139° C. | A | 0.03 | A | 1.10 | C |
| 22 | 22 | 60° C. | A | 143° C. | A | 0.04 | B | 1.10 | C |
| 23 | 23 | 60° C. | A | 137° C. | A | 0.02 | A | 1.20 | B |
| 24 | 24 | 60° C. | A | 146° C. | B | 0.04 | B | 1.27 | A |
| 25 | 25 | 60° C. | A | 143° C. | A | 0.06 | C | 1.20 | B |
| 26 | 26 | 60° C. | A | 154° C. | C | 0.06 | C | 1.20 | B |
| 27 | 27 | 60° C. | A | 154° C. | C | 0.06 | C | 1.20 | B |
| 28 | 28 | 56° C. | B | 140° C. | A | 0.05 | B | 1.10 | C |
| 29 | 29 | 56° C. | B | 140° C. | A | 0.07 | C | 1.10 | C |
| 30 | 30 | 56° C. | B | 138° C. | A | 0.06 | C | 1.20 | B |
| 31 | 31 | 54° C. | B | 138° C. | A | 0.07 | C | 1.20 | B |
| 32 | 32 | 56° C. | B | 140° C. | A | 0.07 | C | 1.10 | C |
| C.E. 1 | Comparative 1 | 52° C. | C | 141° C. | A | 0.12 | D | 1.02 | D |
| C.E. 2 | Comparative 2 | Less than 50° C. | D | 145° C. | B | 0.05 | B | 1.06 | C |
| C.E. 3 | Comparative 3 | 60° C. | A | 135° C. | A | 0.04 | B | 1.02 | D |
| C.E. 4 | Comparative 4 | 50° C. | C | 143° C. | A | 0.02 | A | 1.02 | D |
| C.E. 5 | Comparative 5 | Less than 50° C. | D | 139° C. | A | 0.02 | A | 1.02 | D |
| C.E. 6 | Comparative 6 | Less than 50° C. | D | 142° C. | A | 0.09 | D | 1.02 | D |
| C.E. 7 | Comparative 7 | 60° C. | A | 140° C. | A | 0.09 | D | 1.04 | D |

$3.00 \leq (SP_{21}-SP_{11}) \leq 25.00$ when $SP_{11}$ $(J/cm^3)^{0.5}$ is the SP value of the first monomer unit, and $SP_{21}$ $(J/cm^3)^{0.5}$ is the SP value of the second monomer unit, the crystalline resin consisting of polymer A is the only crystalline resin contained in the binder resin, the first polymerizable monomer being at least one selected from the group consisting of (meth)acrylic acid esters having a $C_{18-36}$ alkyl group, and the third polymerizable monomer is at least one selected from the group consisting of styrene, methyl methacrylate and methyl acrylate.

2. A toner, comprising:

a toner particle containing a binder resin, the binder resin containing a crystalline resin consisting of a polymer A that is a polymer of a composition containing first, second and third polymerizable monomers that are mutually different from each other, wherein a content of the first polymerizable monomer in the composition is 5.0 to 60.0 mol % of the total moles of all polymerizable monomers in the composition, a content of the second polymerizable monomer in the composition is 20.0 to 95.0 mol % of the total moles of all polymerizable monomers in the composition, a storage elastic modulus Gt' (150) of the toner at 150° C. is at least $1.0 \times 10^4$ Pa, $0.60 \leq (SP_{22}-SP_{12}) \leq 15.00$ when $SP_{12}$ $(J/cm^3)^{0.5}$ is the SP value of the first polymerizable monomer, and $SP_{22}$ $(J/cm^3)^{0.5}$ is the SP value of the second polymerizable monomer, the crystalline resin consisting of polymer A is the only crystalline resin contained in the binder resin, the first polymerizable monomer is at least one selected from the group consisting of (meth)acrylic acid esters having a $C_{18-36}$ alkyl group, and the third polymerizable monomer is at least one selected from the group consisting of styrene, methyl methacrylate and methyl acrylate.

3. The toner according to claim 1, wherein the binder resin contains a polymer B different from the polymer A, and the polymer B contains a polyester resin having a monomer unit derived from a polyhydric alcohol and a monomer unit derived from a polyvalent carboxylic acid.

4. The toner according to claim 1, wherein the binder resin contains a polymer B different from the polymer A, and the polymer B contains a polyester resin having a monomer unit derived from a polyhydric alcohol and a monomer unit derived from a polyvalent carboxylic acid, and $0.0 \leq |(SP_{41}-SP_{21})| \leq 6.5$ when $SP_{41}$ $(J/cm^3)^{0.5}$ is the SP value of the monomer unit derived from a polyvalent carboxylic acid.

5. The toner according to claim 2, wherein the binder resin contains a polymer B different from the polymer A, and the polymer B contains a polyester resin having a monomer unit derived from a polyhydric alcohol and a monomer unit derived from a polyvalent carboxylic acid, and $0.0 \leq |(SP_{42}-SP_{22})| \leq 5.0$ when $SP_{42}$ $(J/cm^3)^{0.5}$ is the SP value of the polyvalent carboxylic acid.

6. The toner according to claim 1, wherein the second polymerizable monomer is at least one selected from the group consisting of formulae (A) and (B)

(A)

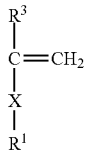

-continued (B)

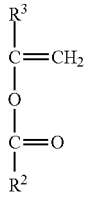

where X represents a single bond or $C_{1-6}$ alkylene group, $R^1$ represents a nitrile group (—C≡N), amide group (—C(=O)$NHR^{10}$ (in which $R^{10}$ is a hydrogen atom or $C_{1-4}$ alkyl group)), hydroxyl group, —$COOR^{11}$ (in which $R^{11}$ is a $C_{1-6}$ alkyl group or $C_{1-6}$ hydroxyalkyl group), urea group (—NH—C(=O)—$N(R^{13})_2$ (in which $R^{13}$ is independently a hydrogen atom or $C_{1-6}$ alkyl group), —$COO(CH_2)_2NHCOOR^{14}$ (in which $R^{14}$ is a $C_{1-4}$ alkyl group) or —$COO(CH_2)_2$—NH—C(=O)—$N(R^{15})_2$ (in which $R^{15}$ is independently a hydrogen atom or $C_{1-6}$ alkyl group), $R^2$ is a $C_{1-4}$ alkyl group, and $R^3$ is a hydrogen atom or methyl group.

7. The toner according to claim 1, wherein a weight average molecular weight in molecular weight distribution measurement of the tetrahydrofuran-soluble component of the toner is at least 30,000.

8. The toner according to claim 1, wherein in viscoelasticity measurement of the tetrahydrofuran-soluble component of the toner, $Gk'(50) \leq 1.0 \times 10^7$ Pa and $Gk'(100) \leq 1.0 \times 10^4$ Pa where Gk'(50) is the storage elastic modulus at 50° C. and Gk'(100) is the storage elastic modulus at 100° C.

9. The toner according to claim 1, wherein the endothermic quantity is not more than 4.0 J/g in DSC measurement of the tetrahydrofuran-insoluble component of the toner.

10. The toner according to claim 1, wherein the polymer A is a vinyl polymer.

11. The toner according to claim 1, wherein the toner is a pulverized toner.

12. A method for manufacturing the toner according to claim 1, wherein the method comprises a step of melt kneading the polymer A.

13. The toner according to claim 2, wherein the second polymerizable monomer is at least one selected from the group consisting of formulae (A) and (B)

(A)

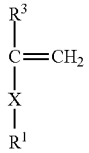

(B)

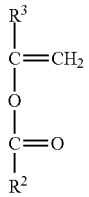

where X represents a single bond or $C_{1-6}$ alkylene group, $R^1$ represents a nitrile group (—C≡N), amide group (—C(=O)$NHR^{10}$ (in which $R^{10}$ is a hydrogen atom or $C_{1-4}$ alkyl group)), hydroxyl group, —$COOR^{11}$ (in which $R^{11}$ is a $C_{1-6}$ alkyl group or $C_{1-6}$ hydroxyalkyl group), urea group (—N—C(=O)—$N(R^{13})_2$ (in which $R^{13}$ is independently a hydrogen atom or $C_{1-6}$ alkyl group), —$COO(CH_2)_2NHCOOR^{14}$ (in which $R^{14}$ is a $C_{1-4}$ alkyl group) or —$COO(CH_2)_2$—NH—C(=O)—$N(R^{15})_2$ (in which $R^{15}$ is independently a hydrogen atom or $C_{1-6}$ alkyl group), $R^2$ is a $C_{1-4}$ alkyl group, and $R^3$ is a hydrogen atom or methyl group.

14. The toner according to claim 2, wherein the polymer A has a third monomer unit derived from a third polymerizable monomer different from the first polymerizable monomer and second polymerizable monomer, and the third polymerizable monomer is at least one selected from the group consisting of styrene, methyl methacrylate and methyl acrylate.

15. The toner according to claim 2, wherein in viscoelasticity measurement of the tetrahydrofuran-soluble component of the toner, $Gk'(50) \leq 1.0 \times 10^7$ Pa and $Gk'(100) \leq 1.0 \times 10^4$ Pa where Gk'(50) is the storage elastic modulus at 50° C. and Gk'(100) is the storage elastic modulus at 100° C.

16. The loner according to claim 2, wherein the endothermic quantity is not more than 4.0 J/g in DSC measurement of the tetrahydrofuran-insoluble component of the toner.

* * * * *